US006011478A

United States Patent [19]

Suzuki et al.

[11] Patent Number: 6,011,478

[45] Date of Patent: Jan. 4, 2000

[54] SMOKE SENSOR AND MONITOR CONTROL SYSTEM

[75] Inventors: Takashi Suzuki; Ryuichi Yamazaki; Yuki Yoshikawa, all of Tokyo, Japan

[73] Assignee: Nittan Company, Limited, Tokyo, Japan

[21] Appl. No.: 09/069,086

[22] Filed: Apr. 29, 1998

[30] Foreign Application Priority Data

May 8, 1997 [JP] Japan ..... 9-134267
Mar. 23, 1998 [JP] Japan ..... 10-093951

[51] Int. Cl.[7] ..... G08B 17/10

[52] U.S. Cl. ..... 340/630; 250/574

[58] Field of Search ..... 340/628, 630; 250/573, 574

[56] References Cited

U.S. PATENT DOCUMENTS

| | | | |
|---|---|---|---|
| 5,502,434 | 3/1926 | Minowa et al. | 340/630 |
| 5,576,697 | 11/1996 | Nagashima et al. | 340/630 |
| 5,751,216 | 5/1998 | Narumiya | 340/630 |
| 5,898,377 | 4/1999 | Adachi et al. | 340/630 |

FOREIGN PATENT DOCUMENTS 51-15487 2/1976 Japan .

*Primary Examiner*—Edward Lefkowitz
*Attorney, Agent, or Firm*—Stevens, Davis, Miller & Mosher, L.L.P.

[57] ABSTRACT

A smoke sensor includes a light receiving unit for temporally alternately receiving scattered light of two different wavelengths $\lambda_1$ and $\lambda_2$; a calculating unit for performing a calculation required for smoke detection, on a scattered light output y of the wavelength $\lambda_1$ and a scattered light output g of the wavelength $\lambda_2$ from the light receiving unit; and a smoke detection processing unit for performing a smoke detection process on the basis of a calculation result output from the calculating unit. The calculating unit estimates an output value of one of the scattered light output y of the wavelength $\lambda_1$ and the scattered light output g of the wavelength $\lambda_2$ at a sample timing of the other output, and obtains a ratio of the estimated output value of the one scattered light at the sample timing of the other output to an output value of the other scattered light, as a two-wavelength ratio.

15 Claims, 14 Drawing Sheets

FIG. 7

| TIME (SECOND) | y (n) (%/m) | $g_0$ (n) (%/m) |
|---|---|---|
| 0 | 0 | 0 |
| 1 | | |
| 4 | 0 | 0 |
| 5 | | |
| 8 | 0.10 | 0.02 |
| 9 | | |
| 12 | 0.40 | 0.11 |
| 13 | | |
| 16 | 0.80 | 0.22 |
| 17 | | |
| 20 | 1.40 | 0.39 |
| 21 | | |
| 24 | 2.50 | 0.69 |
| 25 | | |
| 28 | 4.00 | 1.11 |
| 29 | | |
| 32 | 5.00 | 1.39 |
| 33 | | |
| 36 | 5.50 | 1.53 |
| 37 | | |

FIG. 8

| TIME (SECOND) | y (n) (%/m) | g (n) (%/m) |
|---|---|---|
| 0 | 0 | |
| 1 | | 0 |
| 4 | 0 | |
| 5 | | 0.01 |
| 8 | 0.10 | |
| 9 | | 0.05 |
| 12 | 0.40 | |
| 13 | | 0.14 |
| 16 | 0.80 | |
| 17 | | 0.26 |
| 20 | 1.40 | |
| 21 | | 0.47 |
| 24 | 2.50 | |
| 25 | | 0.80 |
| 28 | 4.00 | |
| 29 | | 1.18 |
| 32 | 5.00 | |
| 33 | | 1.42 |
| 36 | 5.50 | |
| 37 | | 1.56 |

FIG. 9

| n TIME (SECOND) | y (n) (%/m) | g (n) (%/m) | CONVENTIONAL TWO-WAVELENGTH RATIO y (n) / g (n) | AVERAGE VALUE OF TWO-WAVELENGTH RATIO |
|---|---|---|---|---|
| 0 | 0 | | | |
| 1 | | 0 | | |
| 4 | 0 | | | |
| 5 | | 0.01 | 0.00 | |
| 8 | 0.10 | | | |
| 9 | | 0.05 | 2.06 | |
| 12 | 0.40 | | | |
| 13 | | 0.14 | 2.88 | |
| 16 | 0.80 | | | |
| 17 | | 0.26 | 3.03 | |
| 20 | 1.40 | | | |
| 21 | | 0.47 | 3.01 | |
| | | | | 3.07 |
| 24 | 2.50 | | | |
| 25 | | 0.80 | 3.13 | |
| 28 | 4.00 | | | |
| 29 | | 1.18 | 3.39 | |
| 32 | 5.00 | | | |
| 33 | | 1.42 | 3.51 | |
| 36 | 5.50 | | | |
| 37 | | 1.56 | 3.52 | |

FIG. 10

( ) IS ESTIMATED VALUE g' (n)

| n TIME (SECOND) | y (n) (%/m) | g (n) (%/m) | TWO-WAVELENGTH RATIO OF THE INVENTION y (n) / g' (n) | AVERAGE VALUE OF TWO-WAVELENGTH RATIO |
|---|---|---|---|---|
| 0 | 0 | (0) | 0 | |
| 1 | | 0 | | |
| 4 | 0 | (0) | 0 | |
| 5 | | 0.01 | | |
| 8 | 0.10 | (0.04) | 2.62 | |
| 9 | | 0.05 | | |
| 12 | 0.40 | (0.12) | 3.44 | |
| 13 | | 0.14 | | |
| 16 | 0.80 | (0.23) | 3.44 | |
| 17 | | 0.26 | | |
| 20 | 1.40 | (0.41) | 3.37 | |
| 21 | | 0.47 | | 3.42 |
| 24 | 2.50 | (0.72) | 3.50 | |
| 25 | | 0.80 | | |
| 28 | 4.00 | (1.09) | 3.69 | |
| 29 | | 1.18 | | |
| 32 | 5.00 | (1.36) | 3.67 | |
| 33 | | 1.42 | | |
| 36 | 5.50 | (1.53) | 3.60 | |
| 37 | | 1.56 | | |

SMOKE SENSOR AND MONITOR CONTROL SYSTEM

BACKGROUND OF THE INVENTION

The invention relates to a smoke sensor which detects smoke, and a monitor control system.

Conventionally, as a light scattering smoke sensor, a smoke sensor is disclosed in, for example, Japanese Patent Unexamined Publication No. Sho. 51-15487. In the disclosed smoke sensor, a light emitting diode is driven by a circuit which generates plus and minus rectangular waves, and two kinds of light of different wavelengths $\lambda_1$ and $\lambda_2$ are temporally alternately emitted by the light emitting diode in response to the plus and minus rectangular waves. A single light receiving device receives scattered light which is produced by smoke or the like from the two kinds of light of different wavelengths $\lambda_1$ and $\lambda_2$ emitted by the light emitting diode. A ratio (two-wavelength ratio) of scattered light outputs of the two different wavelengths $\lambda_1$ and $\lambda_2$ is obtained. It is determined whether the two-wavelength ratio is in a predetermined range or not. If the ratio is in the range, an alarm is activated.

In the smoke sensor, it is intended that the kind (characteristic) of smoke is judged (for example, only smoke in which the particle diameter is in a specific range is detected) by determining whether the two-wavelength ratio is in the predetermined range or not. In other words, the smoke sensor is developed in order to eliminate an influence due to dust, steam, or the like which is not a fire cause, and detect only smoke which is produced by a fire cause.

However, in a smoke sensor configured so as to temporally alternately receive scattered light of two different wavelengths $\lambda_1$ and $\lambda_2$ as described above, the timing of the detection of scattered light of the wavelength $\lambda_1$ is not identical with (the same time as) that of scattered light of wavelength $\lambda_2$. Therefore, a ratio y/g of the scattered light output (light intensity output) y of the wavelength $\lambda_1$ to the scattered light output (light intensity output) g of the wavelength $\lambda_2$, i.e., a two-wavelength ratio contains many errors, and hence accurate smoke detection is limited.

SUMMARY OF THE INVENTION

It is an object of the invention to provide a smoke sensor configured so as to temporally alternately receive scattered light of two different wavelengths $\lambda_1$ and $\lambda_2$, and a monitor control system which uses a smoke sensor of this kind, and more particularly such a smoke sensor and a monitor control system which can correctly obtain a two-wavelength ratio and in which the accuracy of smoke detection can be remarkably enhanced as compared with the prior art.

In order to attain the object, the invention of a first aspect is a smoke sensor in which light receiving means temporally alternately receives scattered light of two different wavelengths $\lambda_1$ and $\lambda_2$, wherein the smoke sensor comprises: calculating means for performing a predetermined calculation required for smoke detection, on a scattered light output y of the wavelength $\lambda_1$ and a scattered light output g of the wavelength $\lambda_2$ from the light receiving means; and smoke detection processing means for performing a smoke detection process on the basis of a calculation result output from the calculating means, and the calculating means estimates an output value of one of the scattered light output y of the wavelength $\lambda_1$ and the scattered light output g of the wavelength $\lambda_2$ which are temporally alternately output from the light receiving means, at a sample timing of the other output, and obtains a ratio of the estimated output value of the one scattered light at the sample timing of the other output to an output value of the other scattered light, as a two-wavelength ratio.

According to the invention of a second aspect, in the smoke sensor according to the first aspect, the calculating means performs the estimation of the output value of one of the scattered light output y of the wavelength $\lambda_1$ and the scattered light output g of the wavelength $\lambda_2$ which are temporally alternately output from the light receiving means, by performing an interpolation on one of the scattered light output y of the wavelength $\lambda_1$ and the scattered light output g of the wavelength $\lambda_2$.

According to the invention of a third aspect, in the smoke sensor according to the first or second aspect, the calculating means takes a moving average of each of the scattered light output y of the wavelength $\lambda_1$ and the scattered light output g of the wavelength $\lambda_2$ from the light receiving means, estimates an output value of one of the moving-averaged scattered light output y of the wavelength $\lambda_1$ and the moving-averaged scattered light output g of the wavelength $\lambda_2$, at a sample timing of the other output, and thereafter obtains a ratio of the estimated output value of the one moving-averaged scattered light at the sample timing of the other output to an output value of the other moving-averaged scattered light, as the two-wavelength ratio.

According to the invention of a fourth aspect, in the smoke sensor according to the first or second aspect, after estimating the output value of one of the scattered light output y of the wavelength $\lambda_1$ and the scattered light output g of the wavelength $\lambda_2$ which are temporally alternately output from the light receiving means, at a sample timing of the other output, the calculating means takes a moving average of the estimated output value and a moving average of the output value of the other scattered light, and obtains a ratio of the estimated output value of the one moving-averaged scattered light at the sample timing of the other output to an output value of the other moving-averaged scattered light, as the two-wavelength ratio.

According to the invention of a fifth aspect, in the smoke sensor according to the first or second aspect, after obtaining a ratio of the estimated output value of the one scattered light at the sample timing of the other output to the output value of the other scattered light, as the two-wavelength ratio, the calculating means takes a moving average on the two-wavelength ratio to obtain another two-wavelength ratio.

According to the invention of a sixth aspect, in the smoke sensor according to any one of the first to fifth aspects, when or after the output value of one of the scattered light output y of the wavelength $\lambda_1$ and the scattered light output g of the wavelength $\lambda_2$ from the light receiving means is equal to or larger than a predetermined value, the calculating means starts the calculation required for smoke detection.

According to the invention of a seventh aspect, in the smoke sensor according to the sixth aspect, after the calculation required for smoke detection is started, and when the output value of one of the scattered light output y of the wavelength $\lambda_1$ and the scattered light output g of the wavelength $\lambda_2$ from the light receiving means reaches an upper limit value, the calculating means holds a calculation result which is obtained immediately before the output value reaches the upper limit value.

According to the invention of an eighth aspect, in the smoke sensor according to any one of the first to seventh aspects, the smoke detection processing means judges a smoke characteristic on the basis of the two-wavelength ratio from the calculating means.

According to the invention of a ninth aspect, in the smoke sensor according to the eighth aspect, when the smoke characteristic is judged, the smoke detection processing means variably sets a fire criterion for each smoke characteristic.

According to the invention of a tenth aspect, in the smoke sensor according to the ninth aspect, the smoke detection processing means variably sets a fire level for judging whether a fire breaks out or not, on the basis of the largeness of the two-wavelength ratio.

The invention of an eleventh aspect is a smoke sensor comprising: controlling means for controlling a whole of the sensor; first light emitting means for, when driven by the controlling means, emitting light of a wavelength $\lambda_1$; second light emitting means for, when driven by the controlling means, emitting light of a wavelength $\lambda_2$; light receiving means for receiving scattered light of the light of the wavelength $\lambda_1$ emitted from the first light emitting means, and scattered light of the light of the wavelength $\lambda_2$ emitted from the second light emitting means; calculating means for performing a predetermined calculation required for smoke detection on a scattered light output y of the wavelength $\lambda_1$ and a scattered light output g of the wavelength $\lambda_2$ from the light receiving means; and smoke detection processing means for performing a smoke detection process on the basis of a calculation result output from the calculating means, the first and second light emitting means being incorporated in a single light emitting device, and the light of the wavelength $\lambda_1$ and the light of the wavelength $\lambda_2$ being emitted from the single light emitting device.

The invention of a twelfth aspect is a smoke sensor comprising: controlling means for controlling a whole of the sensor; first light emitting means for, when driven by the controlling means, emitting light of a wavelength $\lambda_1$; second light emitting means for, when driven by the controlling means, emitting light of a wavelength $\lambda_2$; light receiving means for receiving scattered light of the light of the wavelength $\lambda_1$ emitted from the first light emitting means, and scattered light of the light of the wavelength $\lambda_2$ emitted from the second light emitting means; calculating means for performing a predetermined calculation required for smoke detection on a scattered light output y of the wavelength $\lambda_1$ and a scattered light output g of the wavelength $\lambda_2$ from the light receiving means; and smoke detection processing means for performing a smoke detection process on the basis of a calculation result output from the calculating means, the smoke sensor further comprising light guiding means for guiding the light of the wavelength $\lambda_1$ emitted from the first light emitting means, and the light of the wavelength $\lambda_2$ emitted from the second light emitting means so that the light of the wavelength $\lambda_1$ emitted from the first light emitting means, and the light of the wavelength $\lambda_2$ emitted from the second light emitting means are directed in a same light emission direction.

According to the invention of a thirteenth aspect, in the smoke sensor of the twelfth aspect, a prism is used in the light guiding means.

According to the invention of a fourteenth aspect, in the smoke sensor of the twelfth aspect, a branched optical fiber is used in the light guiding means.

The invention of a fifteenth aspect is a monitor control system comprising a receiver, and an analog light scattering smoke sensor which is connected to a transmission path elongating from the receiver and which is monitored and controlled by the receiver, wherein, when the analog light scattering smoke sensor is a smoke sensor which temporally alternately receives scattered light of two different wavelengths $\lambda_1$ and $\lambda_2$, the receiver comprises: calculating means for performing a predetermined calculation required for smoke detection, on a scattered light output y of the wavelength $\lambda_1$ and a scattered light output g of the wavelength $\lambda_2$ from the light receiving means; and smoke detection processing means for performing a smoke detection process on the basis of a calculation result output from the calculating means, and the calculating means estimates an output value of one of the scattered light output y of the wavelength $\lambda_1$ and the scattered light output g of the wavelength $\lambda_2$ which are temporally alternately output from the light scattering smoke sensor, at a sample timing of the other output, and obtains a ratio of the estimated output value of the one scattered light at the sample timing of the other output to an output value of the other scattered light, as a two-wavelength ratio.

BRIEF DESCRIPTION OF THE DRAWINGS

FIG. 7 is a view illustrating results of a simulation experiment.

FIG. 8 is a view illustrating results of a simulation experiment.

FIG. 9 is a view illustrating results of a simulation experiment.

FIG. 10 is a view illustrating results of a simulation experiment.

DETAILED DESCRIPTION OF THE INVENTION

Figure 1:
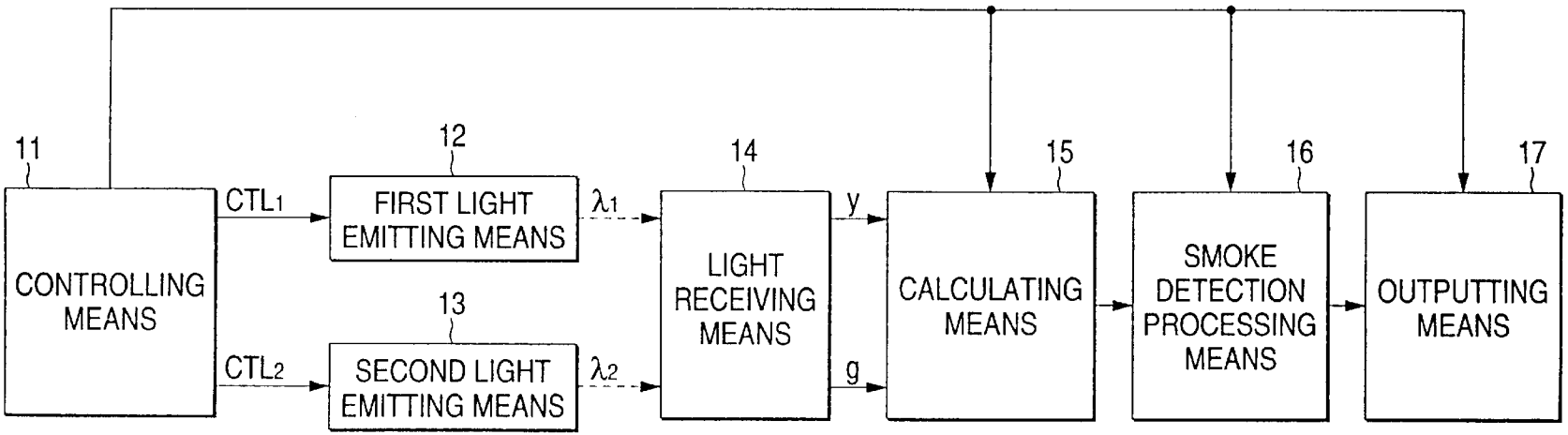
FIG. 1 is a diagram showing an example of the configuration of the smoke sensor of the invention.

Hereinafter, preferred embodiments of the invention will be described with reference to the accompanying drawings. FIG. 1 is a diagram showing an example of the configuration of the smoke sensor of the invention. Referring to FIG. 1, the smoke sensor comprises: controlling means 11 for controlling the whole of the sensor; first light emitting means 12 for, when driven by the controlling means 11, emitting light of a wavelength $\lambda_1$; second light emitting means 13 for, when driven by the controlling means 11, emitting light of a wavelength $\lambda_2$; light receiving means 14 for receiving scattered light of the light of the wavelength $\lambda_1$ emitted from the first light emitting means 12, and scattered light of the light of the wavelength $\lambda_2$ emitted from the second light emitting means 13; calculating means 15 for performing a predetermined calculation required for smoke detection, on a scattered light output (light intensity output) y of the wavelength $\lambda_1$ and a scattered light output (light intensity output) g of the wavelength $\lambda_2$ from the light receiving means 14; smoke detection processing means 16 for performing a smoke detection process on the basis of a calculation result output from the calculating means 15; and outputting means 17 for outputting a result of the smoke detection process.

Figure 2:
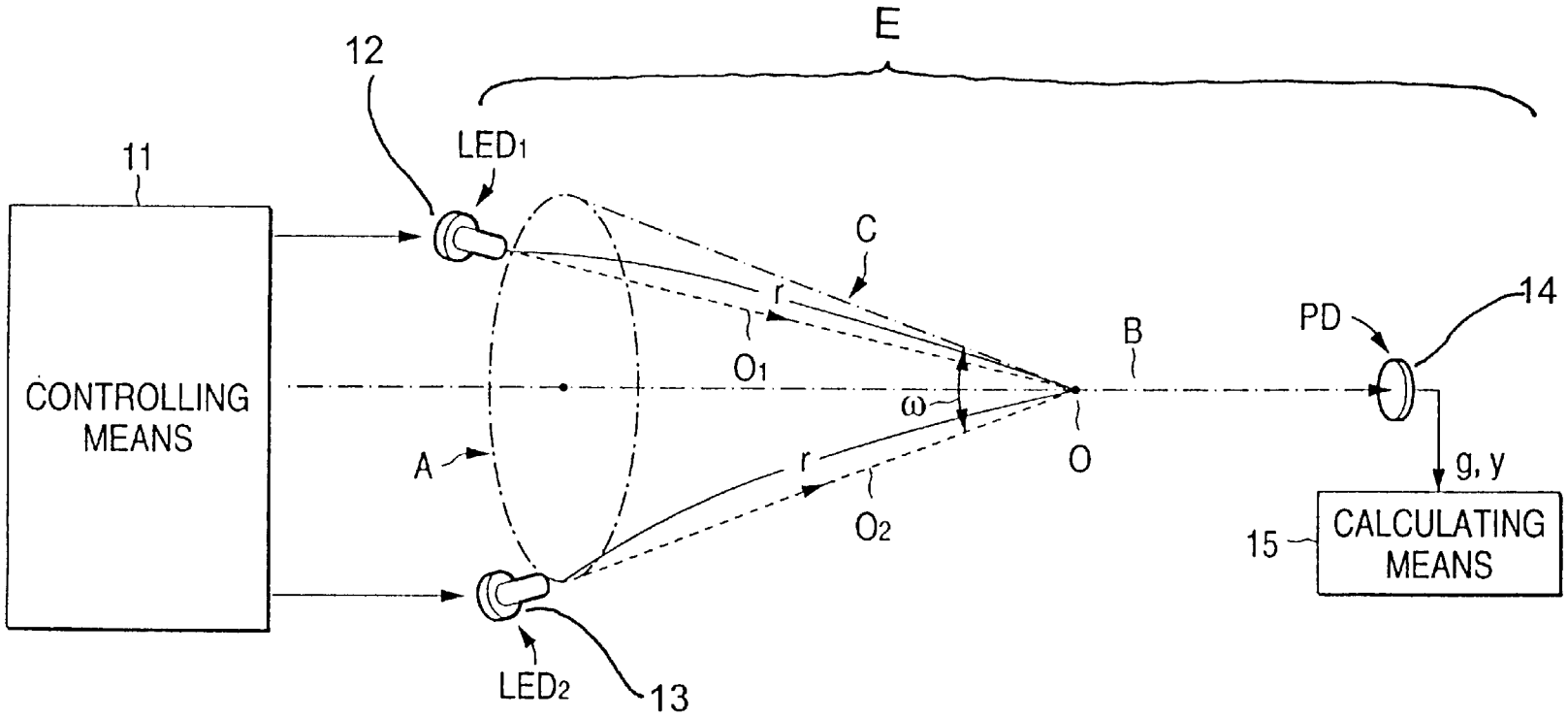
FIG. 2 is a diagram showing an example of the configuration of a physical quantity detecting unit.

FIG. 2 is a diagram showing an example of the configuration of the first light emitting means 12, the second light emitting means 13, and the light receiving means 14. In the example of FIG. 2, the first light emitting means 12 is configured by, for example, a blue light emitting diode $LED_1$ which emits blue light ($\lambda_1$), the second light emitting means 13 is configured by, for example, a near infrared light emitting diode $LED_2$ which emits near infrared light ($\lambda_2$), and the light receiving means 14 is configured by a single light receiving device PD.

The blue light emitting diode $LED_1$ and the near infrared light emitting diode $LED_2$ are located at positions on the outer edge A of the base of a circular cone C in which the apex is an intersection point O of the optical axis $O_1$ of $LED_1$ and the optical axis $O_2$ of $LED_2$ and which has a predetermined apex angle $\omega$. In this case, $LED_1$ and $LED_2$ can be located at arbitrary positions on the outer edge A of the base of the circular cone C. For example, $LED_1$ and $LED_2$ may be housed in a single case and located at positions which are substantially identical with each other and on the outer edge A of the base of the circular cone C.

The light receiving device PD is located at a predetermined position (a predetermined position on the center axis B of the circular cone C) which is on the center axis B of the circular cone C and on the side which is opposite to the side of $LED_1$ and $LED_2$ with respect to the intersection point O of the optical axis $O_1$ of $LED_1$ and the optical axis $O_2$ of $LED_2$. Specifically, the light receiving device PD may be located at, for example, a position which is on the center axis B of the circular cone C and separated from the intersection point O of the optical axis $O_1$ of $LED_1$ and the optical axis $O_2$ of $LED_2$ by the same distance (equidistance) r as the distance r between $LED_1$ and the intersection point O (the distance r between $LED_2$ and the intersection point O).

According to this arrangement, the angles formed by the two light emitting diodes $LED_1$ and $LED_2$ and the light receiving device PD can be set to be equal to each other, and the scattering angles can be set to be equal to each other. The space E among the blue light emitting diode $LED_1$, the near infrared light emitting diode $LED_2$, and the light receiving device PD constitutes an environment (for example, a chamber) in which smoke to be detected can exist.

The first light emitting means 12 ($LED_1$) and the second light emitting means 13 ($LED_2$) are driven and controlled by driving signals $CTL_1$ and $CTL_2$ from the controlling means 11, respectively.

Figure 3:
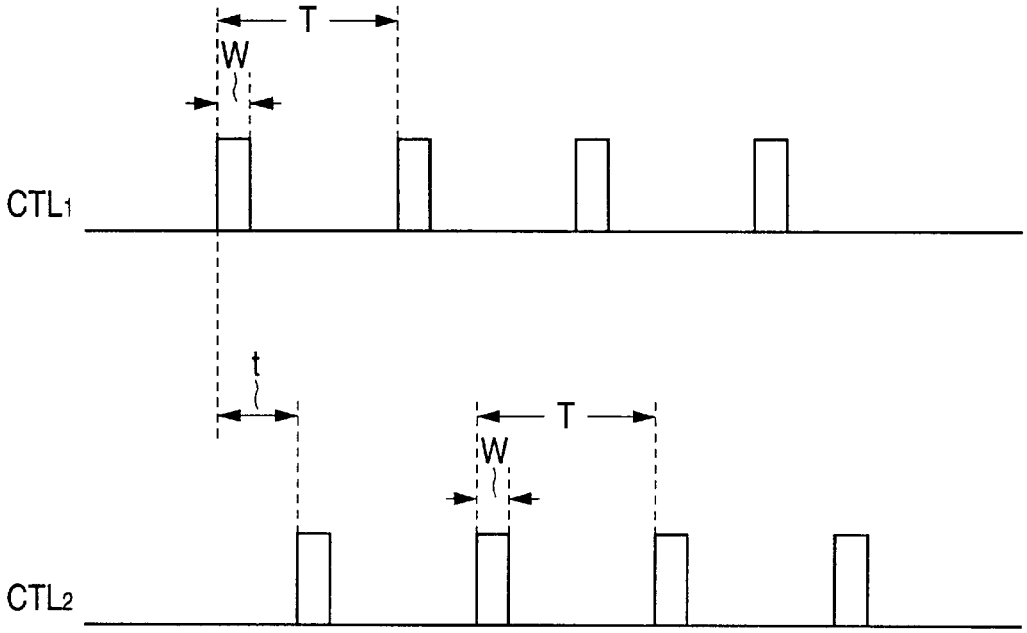
FIG. 3 is a time chart showing an example of driving signals $CTL_1$ and $CTL_2$.

FIG. 3 is a time chart showing an example of the driving signals $CTL_1$ and $CTL_2$. In the example of FIG. 3, the driving signals $CTL_1$ and $CTL_2$ have the same pulse width and period. In other words, both the signals have a pulse width of W and a period of T. However, the driving signal $CTL_2$ is delayed from the driving signal $CTL_1$ by a predetermined time period t ($t<T$).

When the driving signals $CTL_1$ and $CTL_2$ are used, the first light emitting means 12 ($LED_1$) emits light of the wavelength $\lambda_1$ (blue light) with the period T during a period corresponding to the pulse width W, and the second light emitting means 13 ($LED_2$) emits light of the wavelength $\lambda_2$ (near infrared light) with the period T during a period corresponding to the pulse width W with being delayed from the emission of the light of the wavelength $\lambda_1$ (blue light) from the first light emitting means 12 ($LED_1$).

A sample timing (sampling period T) when scattered light (blue light) of the light of the wavelength $\lambda_1$ from the first light emitting means 12 ($LED_1$) is sampled in the light receiving means 14 (PD) is shifted by the time period t from a sample timing (sampling period T) when the light of the wavelength $\lambda_2$ (near infrared light) from the second light emitting means 13 ($LED_2$) is sampled in the light receiving means 14 (PD). This shift of the time period t causes the scattered light of two different wavelengths $\lambda_1$ and $\lambda_2$ to be temporally alternately emitted, so that the light receiving means 14 (PD) temporally alternately receives the scattered light of two different wavelengths $\lambda_1$ and $\lambda_2$. As a result, in the light receiving means 14 (PD), the light intensities y and g of the scattered light of two different wavelengths $\lambda_1$ and $\lambda_2$ can be temporally alternately obtained.

The light intensity y of the scattered light of the wavelength $\lambda_1$ reflects the smoke density (%/m) of the environment E with respect to the light of the wavelength $\lambda_1$, and the light intensity g of the scattered light of the wavelength $\lambda_2$ reflects the smoke density (%/m) of the environment E with respect to the light of the wavelength $\lambda_2$. For the sake of convenience, the following description will be made on the assumption that the light intensity of scattered light has been converted to the smoke density (%/m).

A smoke sensor configured so that the light receiving means 14 temporally alternately receives scattered light of two different wavelengths $\lambda_1$ and $\lambda_2$ in this way has the following drawback. As described above, the sample timing (sampling period T) when scattered light (blue light) of the wavelength $\lambda_1$ is sampled in the light receiving means 14 (PD) is shifted by the time period t from the sample timing (sampling period T) when the light of the wavelength $\lambda_2$ (near infrared light) is sampled in the light receiving means 14 (PD) (that is, in the light receiving means 14 (light receiving device PD), the sample timing (light receiving timing) of scattered light of the wavelength $\lambda_1$ is not identical with the sample timing (light receiving timing) of scattered light of the wavelength $\lambda_2$ (there is a time difference t)). In such a case that when the smoke density of the environment E is suddenly changed during the time difference t and the light receiving signal is abruptly changed, when the ratio (two-wavelength ratio: y/g) of the scattered light output (sampled output) y of the wavelength $\lambda_1$ to the scattered light output (sampled output) g of the wavelength $\lambda_2$ from the light receiving means 14 is obtained, the two-wavelength ratio contains many errors.

In order to prevent the two-wavelength ratio from containing many errors because of the time difference t, the calculating means 15 of the smoke sensor of the invention is configured so as to estimate the output value of one of the scattered light output (sampled output) y of the wavelength $\lambda_1$ and the scattered light output (sampled output) g of the wavelength $\lambda_2$ which are temporally alternately output from the light receiving means 14, at the sample timing of the other output, and obtain a ratio of the estimated output value of the one scattered light at the sample timing of the other output to an output value of the other scattered light, as the two-wavelength ratio.

Figure 4:
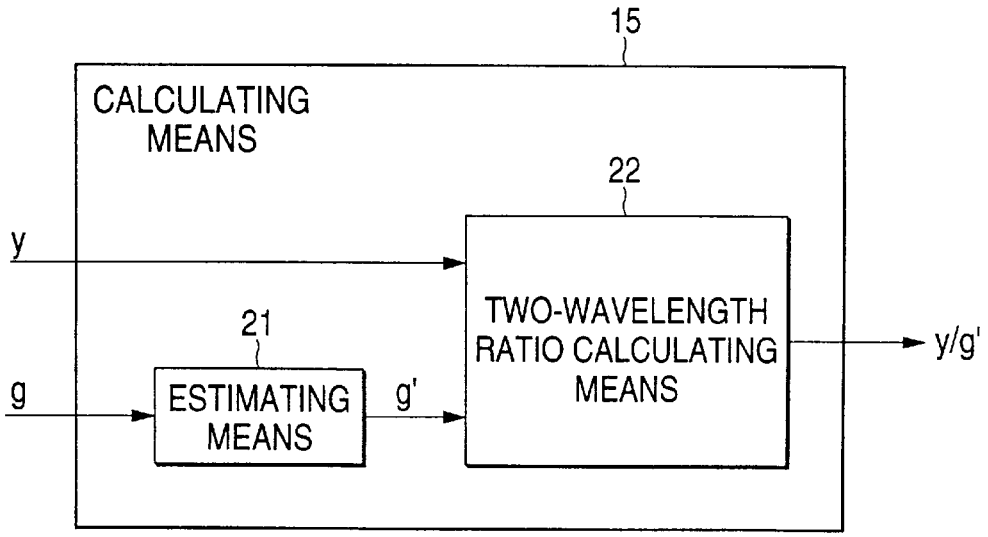
FIG. 4 is a diagram showing an example of the configuration of calculating means.
Figure 5:
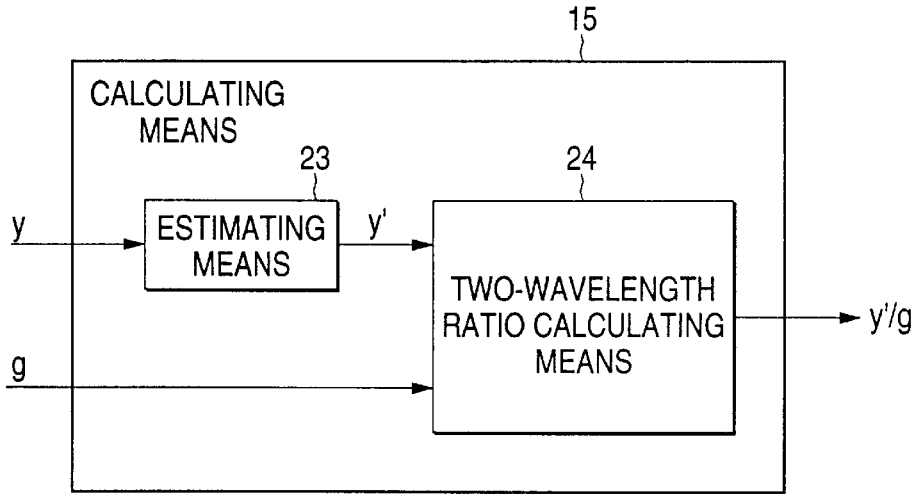
FIG. 5 is a diagram showing an example of the configuration of the calculating means.

FIGS. 4 and 5 are diagrams respectively showing examples of the configuration of the calculating means 15. The example of FIG. 4 comprises: estimating means 21 for estimating the output value g' of the scattered light output (sampled output) g of the wavelength $\lambda_2$ at the same sample timing as that of the scattered light output (sampled output) y of the wavelength $\lambda_1$; and two-wavelength ratio calculating means 22 for calculating a ratio (y/g') of the scattered light output (sampled output) y of the wavelength $\lambda_1$ to the thus estimated scattered light output (sampled output) g' of the wavelength $\lambda_2$, as the two-wavelength ratio.

The example of FIG. 5 comprises: estimating means 23 for estimating the output value y' of the scattered light output (sampled output) y of the wavelength $\lambda_1$ at the same sample timing as that of the scattered light output (sampled output) g of the wavelength $\lambda_2$; and two-wavelength ratio calculating means 24 for calculating a ratio (y'/g) of the thus estimated scattered light output (sampled output) y' of the wavelength $\lambda_1$ to the scattered light output (sampled output) g of the wavelength $\lambda_2$, as the two-wavelength ratio.

Figure 6:
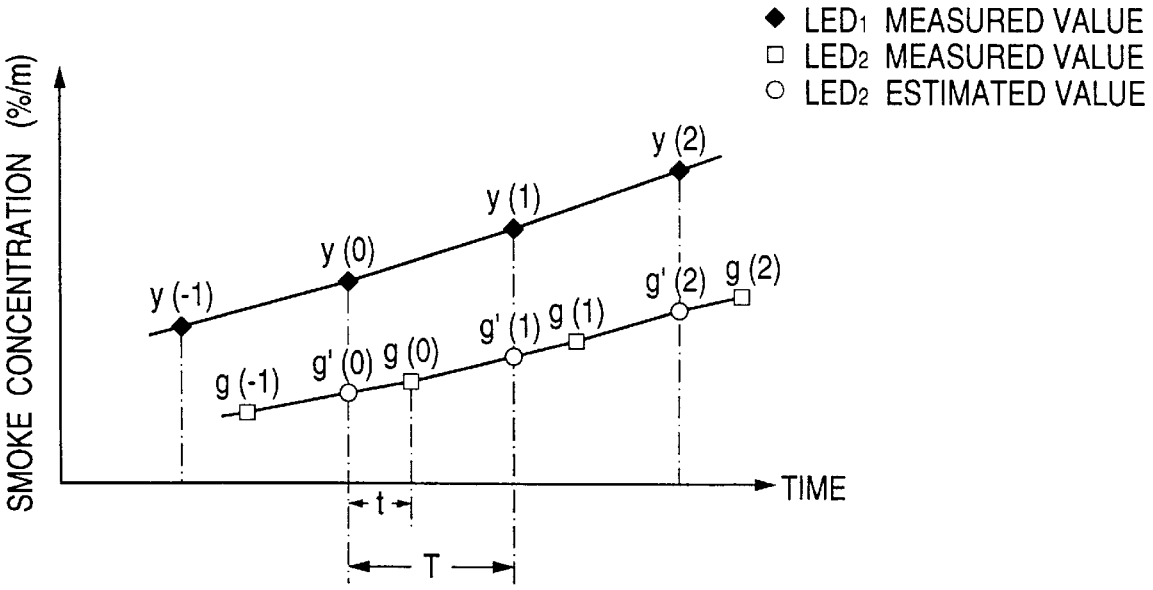
FIG. 6 is a view illustrating an example of an estimation process.

FIG. 6 is a view illustrating an example of the estimation process in the estimating means 21 in the case where the calculating means 15 has the configuration of FIG. 4. Referring to FIG. 6, the scattered light output (sampled output) y of the wavelength $\lambda_1$ is sampled as y(−1), y(0), y(1), y(2), . . . at sample timings −1, 0, 1, 2, . . . of the period T, and also the scattered light output (sampled output) g of the wavelength $\lambda_2$ is sampled as g(−1), g(0), g(1), g(2), . . . at sample timings −1, 0, 1, 2, . . . of the period T. However, the sampling for the sampled outputs g(−1), g(0), g(1), g(2), . . . of the scattered light output (sampled output) g of the wavelength $\lambda_2$ is performed at a timing delayed by the time difference t from the sampled outputs y(−1), y(0), y(1), y(2), . . . of the scattered light output (sampled output) y of the wavelength $\lambda_1$.

In this case, an interpolation such as that of the following expression is performed on the sampled outputs g(−1), g(0), g(1), g(2), . . . of the scattered light output (sampled output) g of the wavelength $\lambda_2$, so that output values g'(−1), g'(0), g'(1), g'(2), . . . at the same timings as those of the sampled outputs y(−1), y(0), y(1), y(2), . . . of scattered light output (sampled output) y of the wavelength $\lambda_1$ can be estimated. [Expression 1]

$$g'(n)=g(n)-(g(n)-g(n-1))\cdot t/T$$

In Expression 1, n is a positive or negative integer ( . . . , −1, 0, 1, 2, . . . ), T is the sampling period of y and g, and t is a time difference between the sample timing of y and that of g.

In the interpolation of Expression 1, for example, the estimated value g'(0) of the scattered light output (sampled output) g of the wavelength $\lambda_2$ which value corresponds to the sample timing 0 (y(0)) of the scattered light output (sampled output) y of the wavelength $\lambda_1$ can be calculated by using the output value (measured value) g(−1) at the sample timing −1 of the scattered light output (sampled output) g of the wavelength $\lambda_2$ and the output value (measured value) g(0) at the sample timing 0 of the scattered light output (sampled output) g of the wavelength $\lambda_2$, as $$g'(0)=g(0)-(g(0)-g(-1))\cdot t/T.$$

FIG. 6 further shows the estimated values g'(−1), g'(0), g'(1), g'(2), . . . of the scattered light output (sampled output) g of the wavelength $\lambda_2$ which are estimated in accordance with Expression 1. As seen from FIG. 6 also, in the example of the estimation process (the example of the interpolation) according to Expression 1, g'(n) is obtained by applying linear interpolation on most adjacent output values (measured values) g(n−1) and g(n) of the scattered light output (sampled output) g of the wavelength $\lambda_2$.

According to the estimation process (in the example of FIG. 6, linear interpolation), for the scattered light output (sampled output) g of the wavelength $\lambda_2$, the output value g' at the same sample timing as that of the scattered light output (sampled output) y of the wavelength $\lambda_1$ can be estimated. When a ratio (y/g') of the scattered light output (sampled output) y of the wavelength $\lambda_1$ to the thus estimated output (sampled output) g' of scattered light of the wavelength $\lambda_2$ is calculated as the two-wavelength ratio, it is possible to eliminate an influence due to the time difference t. As a result, the two-wavelength ratio (y/g') having reduced errors can be obtained.

Therefore, the smoke detection processing means 16 can more correctly judge, for example, the kind (characteristic) of smoke on the basis of the two-wavelength ratio (y/g') having reduced errors and output from the calculating means 15. Specifically, the particle diameter of smoke or the like can be correctly detected on the basis of the two-wavelength ratio (y/g') having reduced errors. According to this configuration, for example, only smoke which is in a specific particle diameter range is correctly detected, so that an influence due to dust, steam, or the like which is not a fire cause can be eliminated and only smoke which is produced by a fire cause can be correctly detected.

The inventors of the present invention actually confirmed the effect by means of simulation experiments. In the simulation experiments, a TF2 fire in which the smoke density of the environment E is gradually increased was assumed. First, a measured value y(n) of scattered light (blue light) of the wavelength $\lambda_1$ from the first light emitting means 12 ($LED_1$) at the sample timing (the sampling period T=4 sec.) in the light receiving means 14 (PD) was obtained. Assuming that an ideal two-wavelength ratio is 3.60 (a TF2 fire is assumed), an ideal output value of light (near infrared light) of the wavelength $\lambda_2$ from the second light emitting means 13 ($LED_2$) at the sample timing (the sampling period T=4 sec.) in the light receiving means 14 (PD) was obtained. Namely, a value which is produced by dividing y(n) by 3.60 was obtained as the ideal output value $g_0(n)$ of light (near infrared light) of the wavelength $\lambda_2$ from the second light emitting means 13 ($LED_2$) in the light receiving means 14 (PD). FIG. 7 shows the measured value y(n) of y, and the ideal output value $g_0(n)$ of g in this stage.

Thereafter, a simulated value of g(n) at a timing which is delayed from y(n) by the time difference t (1 sec.) was obtained by directly subjecting the ideal output value $g_0(n)$ to interpolation. FIG. 8 shows a measured value y(n), and a simulated value g(n) which was obtained as described above. The values y(n) and g(n) shown in FIG. 8 are values which are obtained by actually simulating the scattered light output (sampled output) y of the wavelength $\lambda_1$ and the scattered light output (sampled output) g of the wavelength $\lambda_2$ which are temporally alternately output from the light receiving means 14. In the example of FIG. 8, the time difference t between the measured value y(n) and the simulated value g(n) is 1 sec.

After simulated values y(n) and g(n) which are similar to actually measured values were obtained as described above, a two-wavelength ratio y(n)/g(n) was calculated directly from the simulated values y(n) and g(n) in accordance with a conventional two-wavelength ratio calculating method. Results of the calculations according to the conventional two-wavelength ratio calculating method are shown in FIG. 9.

On the other hand, the estimation process (direct interpolation process) of the invention was performed on the simulated value g(n) of FIG. 8 to obtain an estimated value g'(n). A two-wavelength ratio y(n)/g'(n) was calculated from the measured value y(n) and the estimated value g'(n). Results of the calculations (results of the calculations according to the two-wavelength ratio calculating method of the invention) are shown in FIG. 10.

In the examples of FIGS. 9 and 10, when the values of y(n), g(n), and g'(n) are smaller than 0.1%/m, the two-wavelength ratio (y(n)/g'(n)) is not calculated, and is set to be 0 because a large error due to noises or the like occurs in the value of the two-wavelength ratio.

When FIGS. 9 and 10 are compared with each other, the following will be seen. In the conventional two-wavelength ratio calculating method shown in FIG. 9, the two-wavelength ratio (y(n)/g(n)) has values of 2.06, 2.88, 3.03, . . . For example, an average of the eight values of the two-wavelength ratio (y(n)/g(n)) which are not smaller than 2.00 is 3.07, or substantially different from the two-wavelength ratio of 3.60 to be detected. By contrast, in the two-wavelength ratio calculating method of the invention shown in FIG. 10, the two-wavelength ratio (y(n)/g'(n)) has values of 2.62, 3.44, 3.44, . . . For example, an average of the eight values of the two-wavelength ratio (y(n)/g'(n)) which are not smaller than 2.00 is 3.42, or close to the two-wavelength ratio of 3.60 to be detected.

From the above, it will be seen that the invention can obtain a two-wavelength ratio which is more correct than that obtained in the prior art. According to the invention, therefore, a judgment on the smoke characteristic (for example, a determination on the particle diameter of smoke or the like), that on whether a fire breaks out or a non-fire condition occurs, and the like can be accurately performed on the basis of the two-wavelength ratio which is correctly calculated.

In the above, the example in which the estimation process is performed by the estimating means 21 in the case where the calculating means 15 has the configuration of FIG. 4 has been described. The estimation process is performed in a similar manner by the estimating means 23 in the case where the calculating means 15 has the configuration of FIG. 15 (for example, by a linear interpolation process on y(n)). Also in the case where the calculating means 15 has the configuration of FIG. 5, in the same manner as the case of the configuration of FIG. 4, it is possible to eliminate an influence due to the time difference t, so that the correct two-wavelength ratio (y'/g) having reduced errors can be obtained.

In the example described above, the estimation of g or y in the estimating means 21 or 23 is performed by applying linear interpolation in which most adjacent output values are linearly interpolated. Alternatively, the estimation of g or y may be performed by any technique as far as, for the scattered light output (sampled output) g or y of the wavelength $\lambda_2$ or $\lambda_1$, the output value g' or y' can be estimated at the same sample timing as that of the scattered light output (sampled output) y or g of the wavelength $\lambda_2$ or $\lambda_1$. In the estimation of g, for example, an interpolation process (such as a second interpolation process) may be used in which g'(n) is estimated in consideration of not only most adjacent output values (measured values) g(n−1) and g(n) but also g(n−2) and g(n+1) outside the output values by using g(n−2), g(n−1), g(n), and g(n+1).

In the example described above, the calculating means 15 directly performs the estimation process (interpolation process) on the scattered light output (light intensity output) y of the wavelength $\lambda_1$ and the scattered light output (light intensity output) g of the wavelength $\lambda_2$ from the light receiving means 14, thereby calculating a two-wavelength ratio. Alternatively, a two-wavelength ratio may be calculated by taking a moving average of the scattered light output (light intensity output) y of the wavelength $\lambda_1$ and the scattered light output (light intensity output) g of the wavelength $\lambda_2$ from the light receiving means 14 over a predetermined time period (for example, three to six sampling zones), and then performing an estimation process (interpolation process) on one of the moving-averaged output values <y(n)> and <g(n)>.

In other words, the calculating means 15 may take a moving average each of the scattered light output y(n) of the wavelength $\lambda_1$ and the scattered light output g(n) of the wavelength $\lambda_2$ from the light receiving means 14, estimate an output value of one of the moving-averaged scattered light output <y(n)> of the wavelength $\lambda_1$ and the moving-averaged scattered light output <g(n)> of the wavelength $\lambda_2$, at a sample timing of the other output, and obtain a ratio of an estimated output value of the one moving-averaged scattered light, at the sample timing of the other output, to the output value of the other scattered light, as the two-wavelength ratio. Specifically, for example, moving averages <y(n)> and <g(n)> of the measured values y(n) and g(n) of $LED_1$ and $LED_2$ may be obtained, an interpolation estimated value <g'(n)> may be obtained on the basis of the moving average of <g(n)> of $LED_2$, and a two-wavelength ratio (<y(n)>/<g'(n)>) may be obtained from (the moving average of <y(n)> of the measured value y(n) of $LED_1$) and (the interpolation estimated value <g'(n)> on the basis of the moving average of <g(n)> of the measured value g(n) of $LED_2$).

When the time period in which the moving average is to be taken equals to three sampling zones, the moving averages <y(n)> and <g(n)> for the scattered output y(n) of the wavelength $\lambda_1$ and the scattered output g(n) of the wavelength $\lambda_2$ from the light receiving means 14 can be respectively obtained from the following expressions.

[Expression 2]

$$<y(n)>=(y(n-1)+y(n)+y(n+1))/3$$

$$<g(n)>=(g(n-1)+g(n)+g(n+1))/3$$

Alternatively, the calculating means 15 may estimate an output value of one of the scattered light output y(n) of the wavelength $\lambda_1$ and the scattered light output g(n) of the wavelength $\lambda_2$ which are temporally alternately output from the light receiving means 14, at a sample timing of the other output, take a moving average of the estimated output value, take a moving average of the scattered light other output value, and obtain a ratio of the moving-averaged estimated output value of the one scattered light of the moving average, at the sample timing of the other output, to the moving-averaged output value of the other scattered light, as the two-wavelength ratio. Specifically, for example, an interpolation estimated value g'(n) may be obtained on the basis of the measured value of g(n) of $LED_2$, moving averages <y(n)> and <g'(n)> of the measured values y(n) and the interpolation estimated value g'(n) of $LED_1$ and $LED_2$ may be obtained, and a two-wavelength ratio (<y(n)>/<g'(n)>) may be obtained from (the moving average of <y(n)> of the measured value y(n) of $LED_1$) and (the moving average <g'(n)> of the interpolation estimated value g'(n) of $LED_2$).

When the time period in which the moving average is to be taken equals to three sampling zones, for example, the moving average <g'(n)> for the interpolation estimated value g'(n) can be obtained from the following expression.

[Expression 3]

$$\langle g'(n)\rangle=(g'(n-1)+g'(n)+g'(n+1))/3$$

Alternatively, the calculating means 15 may obtain a ratio of the estimated output value of the one scattered light at the sample timing of the other output to the output value of the other scattered light, as the two-wavelength ratio, and take a moving average of the two-wavelength ratio so that the moving average is finally obtained as the two-wavelength ratio. Specifically, for example, a moving average of a two-wavelength ratio (y(n)/g'(n)) may be obtained, and the moving-averaged two-wavelength ratio (<y(n)/g'(n)>) may be finally obtained as the two-wavelength ratio.

When the time period in which the moving average is to be taken equals to three sampling zones, for example, the moving average (<y(n)>/<g'(n)>) of the two-wavelength ratio (y(n)>/<g'(n)) can be obtained from the following expression.

$$\langle y(n)/g'(n)\rangle = (y(n-1)/g'(n-1) + y(n)/g'(n) + y(n+1)/g'(n+1))/3 \quad \text{[Expression 4]}$$

In this way, the above-mentioned process of further taking a moving average of y(n) and g(n), y(n) and g'(n) or y'(n) and g(n), or the two-wavelength ratio (y(n)/g'(n) or y'(n)>/g(n)) results in a temporal smoothing process, and hence an influence due to temporal fluctuation of smoke density or the like can be remarkably reduced. Consequently, the two-wavelength ratio can be obtained more correctly. When the time period in which the moving average is to be taken is set to be very long, however, the moving average process causes a loss of information. Therefore, the time period in which the moving average is to be taken must be set to have an appropriate value.

In the example described above, the calculating means 15 can always perform the calculation process (the estimation process, the two-wavelength ratio calculation process, and the moving average process). Alternatively, the calculating means may be configured so that, when or after the output value (smoke density) of one of the scattered output y(n) of the wavelength $\lambda_1$ and the scattered output g(n) of the wavelength $\lambda_2$ which are temporally alternately output from the light receiving means 14 becomes equal to or larger than a predetermined value (for example, about 0.1%/m), the calculation process is started. In the alternative, the calculating means 15 is not required to always perform the calculations of the estimation process, the two-wavelength ratio calculation process, and the moving average process. Therefore, the load of the calculating means 15 (specifically, a CPU described later) can be reduced and an influence of noises can be reduced so that the smoke detection error can be further reduced.

When, after the calculation process (the estimation process, the two-wavelength ratio calculation process, and the moving average process) is started, the output value (smoke density) of one of the scattered output y(n) of the wavelength $\lambda_1$ and the scattered output g(n) of the wavelength $\lambda_2$ which are temporally alternately output from the light receiving means 14 reaches an upper limit (in the case where the calculating means 15 has an 8-bit A/D converter, for example, the upper limit is "255"), an overflow occurs and the calculation processes cannot be further performed. In this case, for example, the results (specifically, the two-wavelength ratio and the like) of the calculation process which are obtained immediately before the output value reaches the upper limit may be held, and the calculation process may not be thereafter performed. As the two-wavelength ratio after the timing when the output value reaches the upper limit and the execution of the calculation process is disabled, therefore, the two-wavelength ratio obtained immediately before the output value reaches the upper limit (i.e., the held two-wavelength ratio) may be used.

The upper limit may be arbitrarily set by the designer or the operator. For example, the output value (smoke density) of the scattered output y(n) of the wavelength $\lambda_1$ or the scattered output g(n) of the wavelength $\lambda_2$ substantially linearly changes until the value reaches about 10%/m. By contrast, when the value becomes equal to or larger than about 10%/m, it saturates or nonlinearly changes. The output value may be caused to nonlinearly change, also by settings of circuits such as an amplifier. In the region where the output value (smoke density) of the scattered output y(n) of the wavelength $\lambda_1$ or the scattered output g(n) of the wavelength $\lambda_2$ is nonlinear, the two-wavelength ratio cannot be correctly calculated. In order to avert such a situation, the upper limit may be set by the designer or the like in the course of, for example, the design of the sensor. In an actual situation wherein the smoke density is 10%/m, a fire is vigorously blazing. Therefore, the upper limit is set to a value which is smaller than, for example, 10%/m.

In the smoke detection processing means 16 of the smoke sensor of FIG. 1, a threshold of the two-wavelength ratio may be set in order to judge the kind (characteristic) of smoke on the basis of the two-wavelength ratio from the calculating means 15. In accordance with the value of a ratio of the obtained two-wavelength to the threshold, it is possible to determine the kind (characteristic) of smoke, for example, whether the smoke is caused by a fire (further, whether the smoke is produced by a flaming fire or by a smoldering fire), or by dust, steam, or the like which is not a fire cause.

Figure 11:
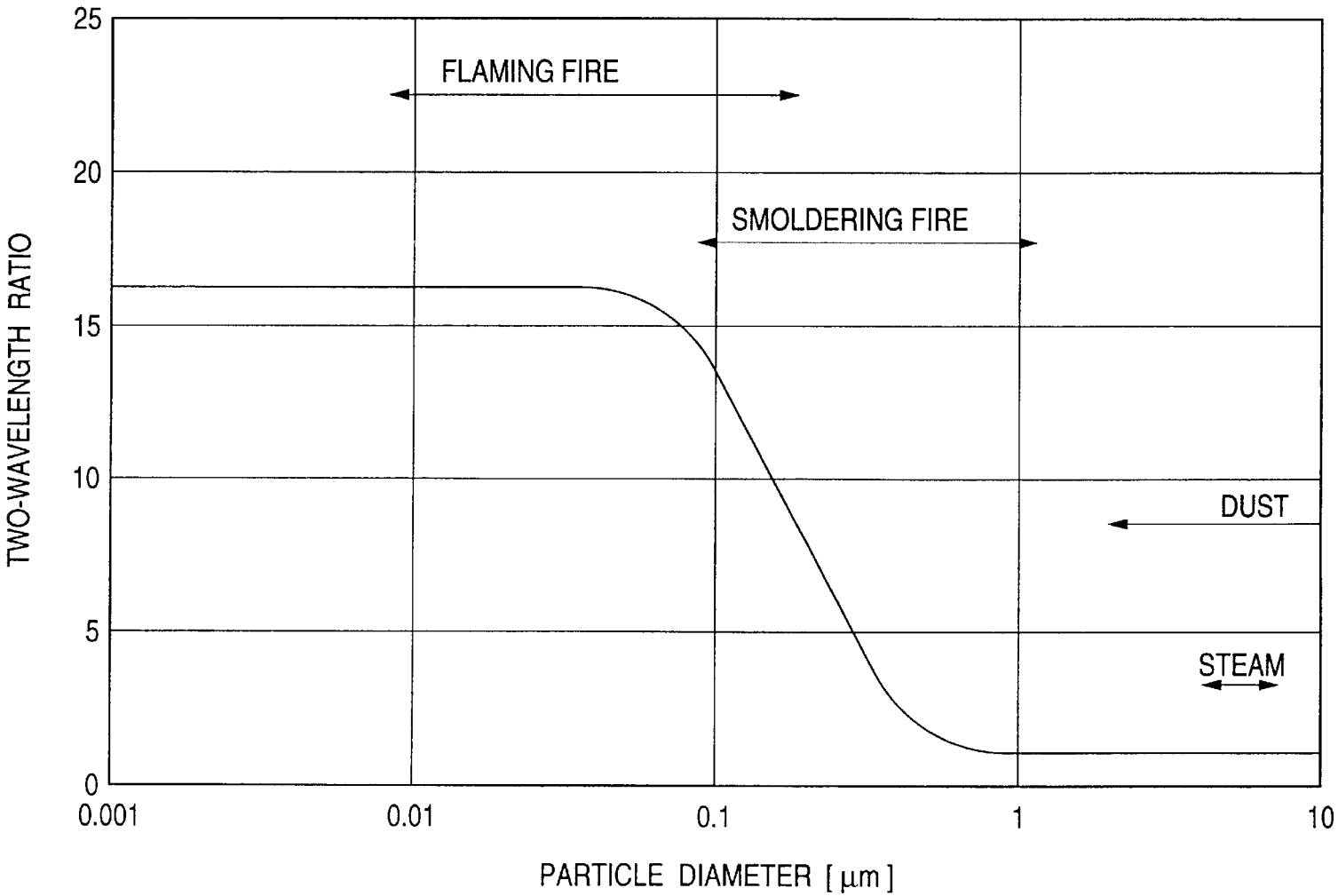
FIG. 11 shows results of experiments on relationships between a two-wavelength ratio and a particle diameter.

The inventors of the present invention investigated relationships between the two-wavelength ratio and a particle diameter in the following manner. Smoke or the like of a predetermined particle diameter was actually introduced into the environment E. At this time, a ratio (y/g') of the scattered light output y of blue light (the wavelength $\lambda_1$=470 nm) to the scattered light output g' of near infrared light (the wavelength $\lambda_2$=945 nm) obtained as a result of the estimation process was obtained as the two-wavelength ratio. FIG. 11 shows results of the experiments on relationships between the two-wavelength ratio and a particle diameter. From FIG. 11, it will be seen that, for smoke having a particle diameter of about 0.001 to 0.1 $\mu$m, the two-wavelength ratio is about 17 to 14; for smoke having a particle diameter of about 0.1 to 1 $\mu$m, the two-wavelength ratio is about 14 to 2; and, for dust, steam, or the like having a particle diameter of 1 $\mu$m or larger, the two-wavelength ratio is 2 or less. From this, it is possible to judge that, when the two-wavelength ratio is about 17 to 10, the smoke is produced by a flaming fire; when the two-wavelength ratio is about 14 to 2, the smoke is produced by a smoldering fire; and, when the two-wavelength ratio is 2 or less, the smoke is produced by dust, steam, or the like.

Based on the two-wavelength ratio, therefore, an influence due to dust, steam, or the like which is not a fire cause can be eliminated and only smoke which is produced by a fire cause can be detected. Furthermore, it is possible to judge whether a fire exists or not, on the basis of, for example, the level relationship between the fire criterion (the threshold for detecting a fire; a fire level) corresponding to the kind of the detected smoke, and the output value of the light receiving means 14.

The smoke detection processing means 16 may be configured so that, when the kind (characteristic) of smoke is judged as described above, the fire criterion is variably set for each smoke characteristic, on the basis of the two-wavelength ratio from the calculating means 15.

When the two-wavelength ratio is small, for example, the possibility of a non-fire is high, and hence the fire level is dulled (the level is lowered) and the accumulation period is prolonged. By contrast, when the two-wavelength ratio is large, the fire level may be set to be high.

The smoke detection processing means 16 may be configured so that, when the two-wavelength ratio is stabilized in the initial stage, the fire is judged to be in the initial condition, the smoke characteristic of the fire is judged during the initial stage of the fire, and the fire criterion is variably set for each smoke characteristic.

Experiment results show that, in the case of a fire, the two-wavelength ratio is relatively stabilized (substantially constant) even in the initial stage, and, in the case of a non-fire, the two-wavelength ratio is largely fluctuated (because smoke particle are small (1 $\mu$m or less) in the case of a fire, and large (several microns) in the case of a non-fire such as steam or dust). When the two-wavelength ratio has a value from which judgment on a fire or a non-fire is hardly performed (for example, the two-wavelength ratio has a value of about 2.00), the fire judgment may be performed on the basis of the experiment results.

According to the invention, the two-wavelength ratio can be obtained more correctly. Therefore, the particle size of smoke can be accurately measured, and the fire judgment or the like can be performed with high reliability, on the basis of the measured particle size.

Figure 12:
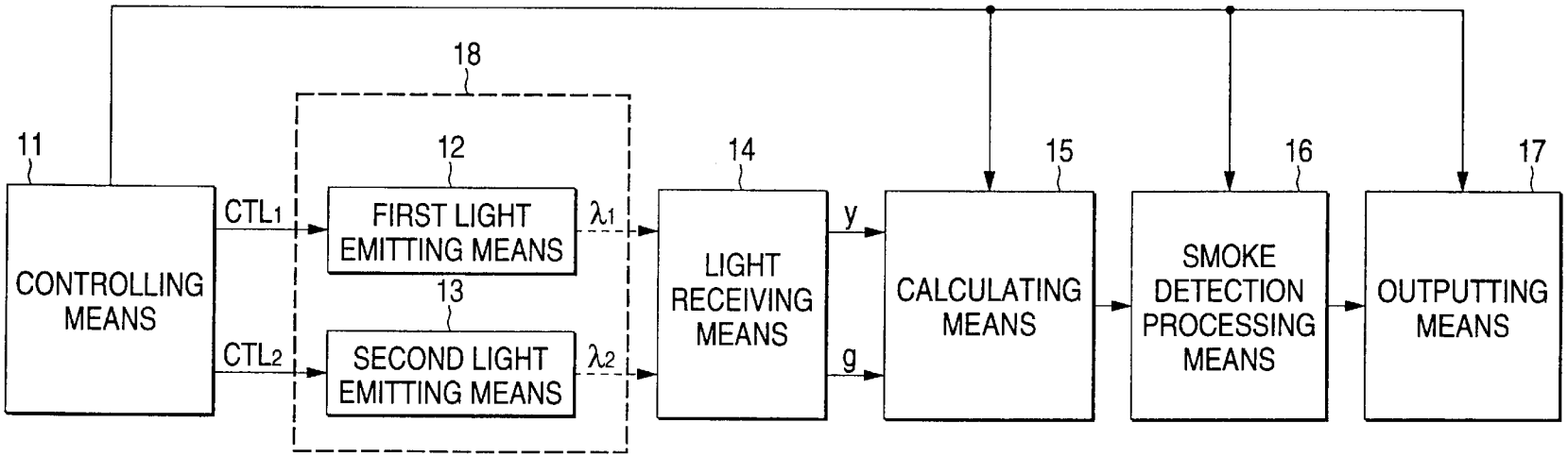
FIG. 12 is a diagram showing an example of the configuration of the smoke sensor of the invention.
Figure 13:
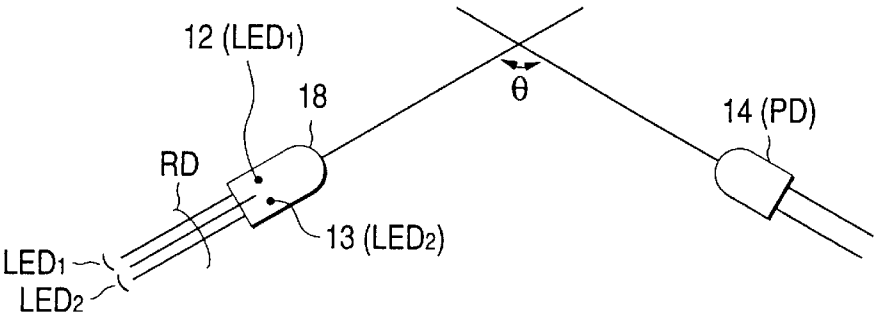
FIG. 13 is a diagram showing a specific example of the smoke sensor of FIG. 12.

FIGS. 12 and 13 are diagrams showing another example of the configuration of the smoke sensor of the invention. The smoke sensor of FIGS. 12 and 13 comprises: controlling means 11 for controlling the whole of the sensor; first light emitting means 12 for, when driven by the controlling means 11, emitting light of a wavelength $\lambda_1$; second light emitting means 13 for, when driven by the controlling means 11, emitting light of a wavelength $\lambda_2$; light receiving means 14 for receiving scattered light of the light of the wavelength $\lambda_1$ emitted from the first light emitting means 12, and scattered light of the light of the wavelength 2 emitted from the second light emitting means 13; calculating means 15 for performing a predetermined calculation required for smoke detection, on a scattered light output (light intensity output) y of the wavelength $\lambda_1$ and a scattered light output (light intensity output) g of the wavelength $\lambda_2$ from the light receiving means 14; smoke detection processing means 16 for performing a smoke detection process on the basis of a calculation result output from the calculating means 15; and outputting means 17 for outputting a result of the smoke detection process. The first light emitting means 12 and the second light emitting means 13 are incorporated in a single light emitting device 18, and the light of the wavelength $\lambda_1$ and that of the wavelength $\lambda_2$ are emitted from the single light emitting device 18.

According to this configuration, the first light emitting means 12 and the second light emitting means 13 can be located at positions which are very close to each other, and the light of the wavelength $\lambda_1$ emitted from the first light emitting means 12, and the light of the wavelength $\lambda_2$ emitted from the second light emitting means 13 are directed in the same light emission direction. In the light scattering smoke sensor, therefore, smoke detection spaces can be made identical with each other, so that the two-wavelength ratio can be correctly obtained. In appearance, the configuration example of FIGS. 12 and 13 is configured by the single light emitting device 18 and the single light receiving device (light receiving means) 14. Therefore, the configuration has an advantage that the structure of a light scattering smoke sensor of the prior art can be used as it is and a product of a low cost can be supplied. Specifically, the example of FIG. 13 is configured so that a light emitting chip $LED_1$ serving as the first light emitting means 12 for emitting light of the wavelength $\lambda_1$, and a light emitting chip $LED_2$ serving as the second light emitting means 13 for emitting light of the wavelength $\lambda_2$ are incorporated in the single light emitting device (LED) 18, and the light emitting chips 12 and 13 can be independently driven through three to four lead wires RD.

Figure 14:
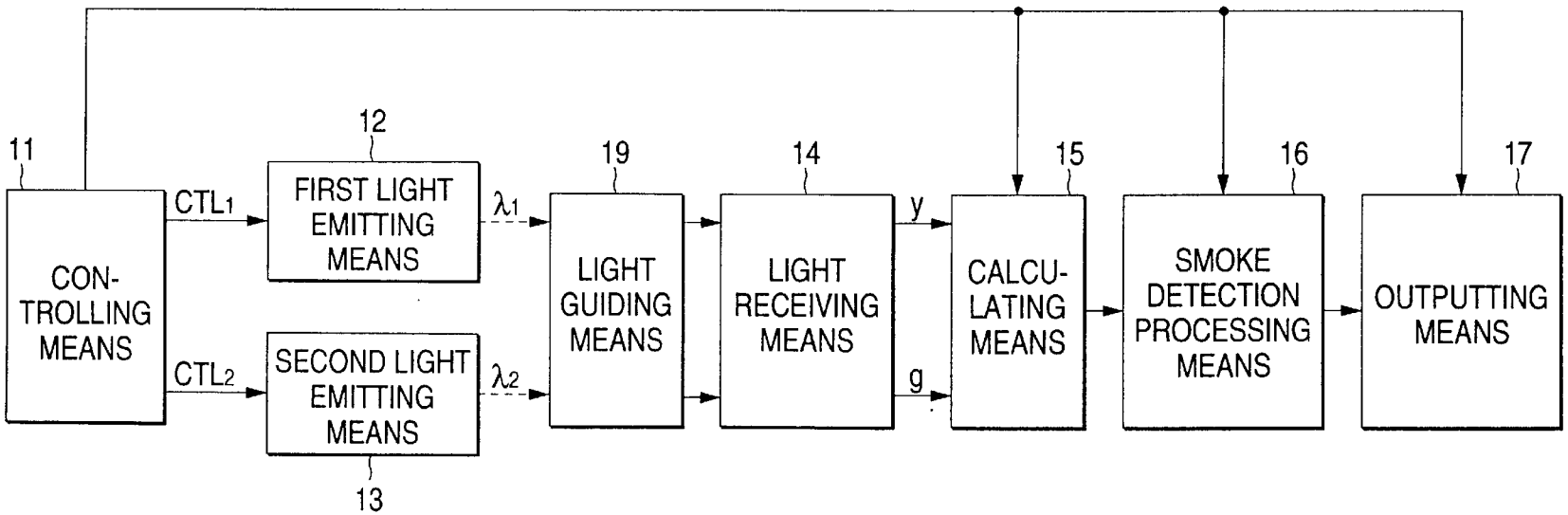
FIG. 14 is a diagram showing an example of the configuration of the smoke sensor of the invention.

FIG. 14 is a diagram showing a further example of the configuration of the smoke sensor of the invention. The smoke sensor of FIG. 14 comprises: controlling means 11 for controlling the whole of the sensor; first light emitting means 12 for, when driven by the controlling means 11, emitting light of a wavelength $\lambda_1$; second light emitting means 13 for, when driven by the controlling means 11, emitting light of a wavelength $\lambda_2$; light receiving means 14 for receiving scattered light of the light of the wavelength $\lambda_1$ emitted from the first light emitting means 12, and scattered light of the light of the wavelength $\lambda_2$ emitted from the second light emitting means 13; calculating means 15 for performing a predetermined calculation required for smoke detection on a scattered light output (light intensity output) y of the wavelength $\lambda_1$ and a scattered light output (light intensity output) g of the wavelength $\lambda_2$ from the light receiving means 14; smoke detection processing means 16 for performing a smoke detection process on the basis of a calculation result output from the calculating means 15; and outputting means 17 for outputting a result of the smoke detection process, and further comprises light guiding means 19 for guiding the light of the wavelength $\lambda_1$ emitted from the first light emitting means 12, and the light of the wavelength $\lambda_2$ emitted from the second light emitting means 13 so that the light of the wavelength $\lambda_1$ emitted from the first light emitting means 12, and the light of the wavelength $\lambda_2$ emitted from the second light emitting means 13 are directed in the same light emission direction. According to this configuration, the light emission direction and emission light path of the light of the wavelength $\lambda_1$ emitted from the first light emitting means 12 can be made identical with those of the light of the wavelength $\lambda_2$ emitted from the second light emitting means 13. In the light scattering smoke sensor, therefore, the smoke detection spaces can be made identical with each other, so that the two-wavelength ratio can be correctly obtained.

Figure 15:
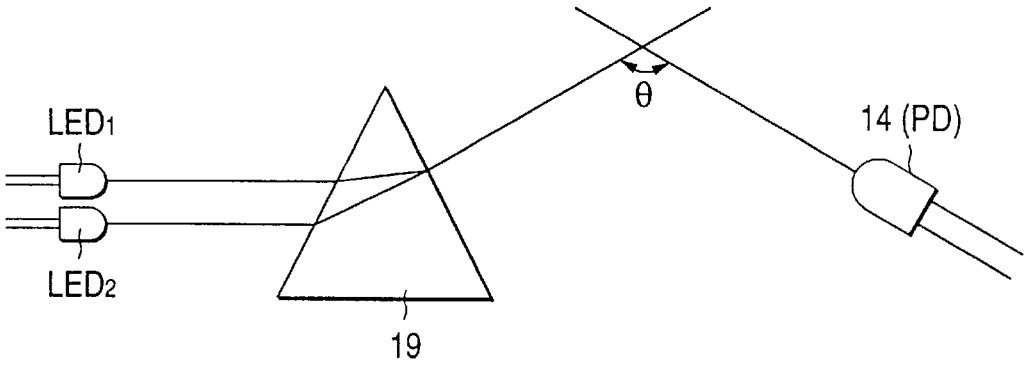
FIG. 15 is a diagram showing a specific example of the smoke sensor of FIG. 14.

FIG. 15 is a diagram showing a specific example of the smoke sensor of FIG. 14. In the example of FIG. 15, $LED_1$ and $LED_2$ are disposed as the first and second light emitting means 12 and 13, respectively, and a prism is used as the light guiding means 19. In the example of FIG. 15, the wavelength of the light emitted from the first light emitting means 12 is different from that of the light emitted from the second light emitting means 13, and therefore the two kinds of light have different angles of refraction in the prism 19. In FIG. 15, a device emitting light of a shorter wavelength which results in a larger angle of refraction is used as $LED_1$, and that emitting light of a longer wavelength which results in a smaller angle of refraction is used as $LED_2$, so that the light emission direction and emission light path of the light of the wavelength $\lambda_1$ emitted from the first light emitting means 12 can be made identical with those of the light of the wavelength $\lambda_2$ emitted from the second light emitting means 13, by the prism 19.

Figure 16:
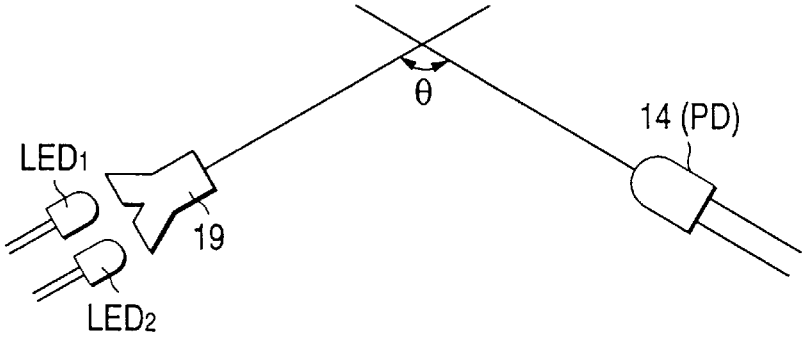
FIG. 16 is a diagram showing a specific example of the smoke sensor of FIG. 14.

FIG. 16 is a diagram showing another specific example of the smoke sensor of FIG. 14. In the example of FIG. 16, $LED_1$ and $LED_2$ are disposed as the first and second light emitting means 12 and 13, respectively, and a branched optical fiber is used as the light guiding means 19. In the example of FIG. 16, the use of the optical fiber enables the light emission direction and emission light path of the light of the wavelength $\lambda_1$ emitted from the first light emitting means 12 to be identical with those of the light of the wavelength $\lambda_2$ emitted from the second light emitting means 13. In the example of FIG. 16, the optical fiber may be replaced with a plastic member or the like.

As described above, in the example of FIG. 14, the use of the prism or the optical fiber enables the first and second light emitting means 12 and 13 (i.e., the two $LED_1$ and $LED_2$ of two different wavelengths) to be independently selected, and hence best devices such as those of high luminance can be used.

As described above, in the configuration example of FIGS. 12 to 16, the smoke detection spaces can be made identical with each other, and hence the two-wavelength ratio can be correctly obtained.

In the invention, the configuration example shown in FIGS. 1 to 11 may be suitably combined with that of FIGS. 12 to 16 in an arbitrary manner. In this case, not only the smoke detection timings but also the smoke detection spaces can be made identical with each other, and hence the two-wavelength ratio can be more correctly obtained.

Figure 17:
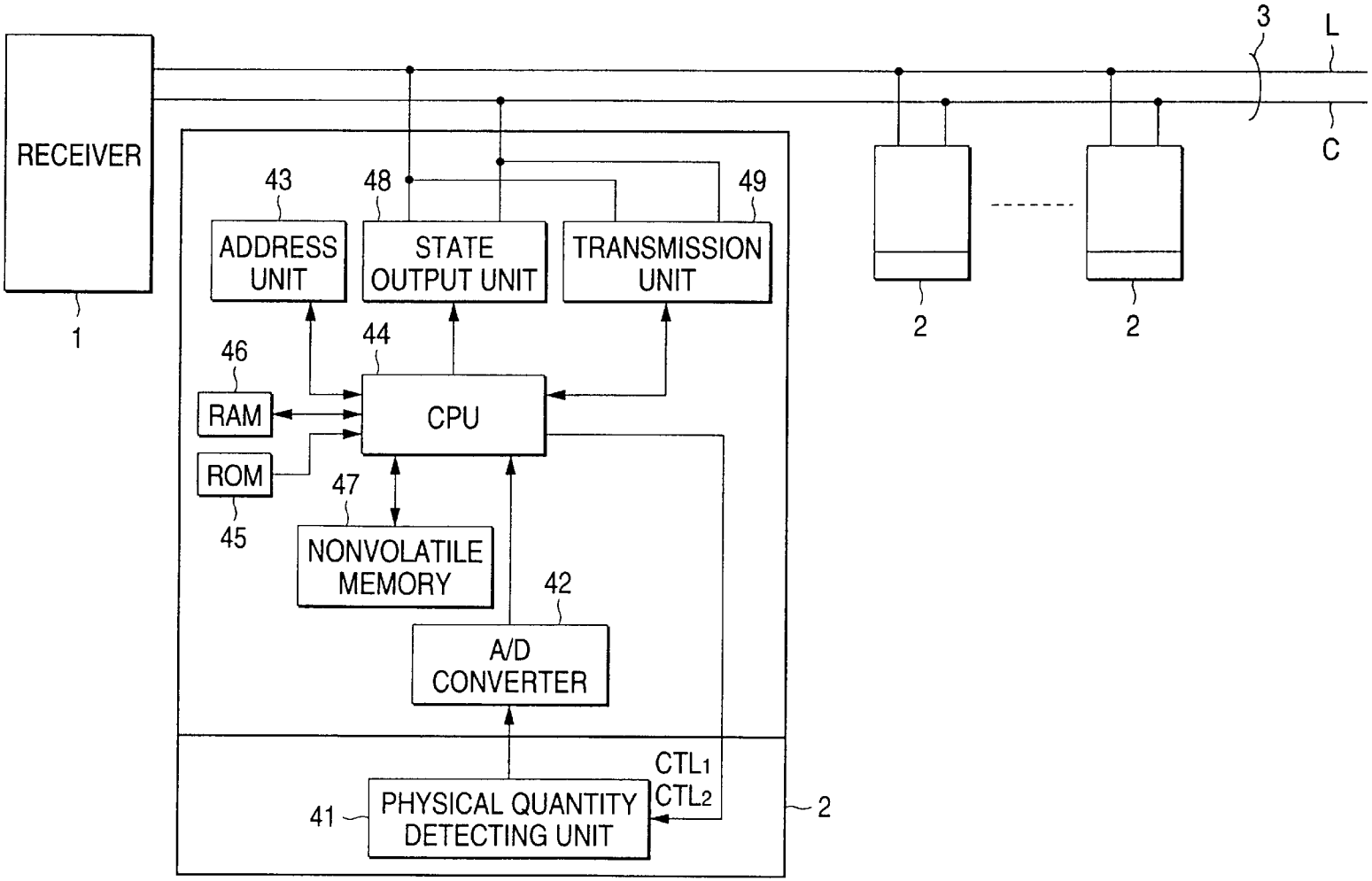
FIG. 17 is a diagram showing a specific example of the smoke sensor of FIG. 1, 12, or 14.

FIG. 17 is a diagram showing a specific example of the smoke sensor of FIG. 1, 12, or 14. In the example of FIG. 17, the smoke sensor comprises: a physical quantity detecting unit 41 for detecting the smoke density as a physical quantity and converting the physical quantity into an electric signal (analog signal); an A/D converter 42 which samples the analog signal output from the physical quantity detecting unit 41 with a predetermined period to convert the signal into a digital signal; an address unit 43 into which the address of the smoke sensor is set; the CPU 44 which performs the control of the whole of the sensor, such as a judgment of an abnormality (for example, a fire); a ROM 45 in which control programs for the CPU 44, and the like are stored; a RAM 46 which is used as work areas of various kinds; a nonvolatile memory 47 in which individual data peculiar to the sensor, and the like are stored; a state output unit 48 which outputs a signal indicative of the operation state (the ON state) to a transmission line (for example, L and C lines) 3 when the detection result (the output level of the A/D converter 42) of the physical quantity (smoke density) which is detected by the physical quantity detecting unit 41 and then converted into a digital signal by the A/D converter 42 exceeds, for example, a predetermined operation threshold level (e.g., the fire level) and the CPU 44 judges that an abnormality such as a fire occurs; and a transmission unit (communication interface unit) 49 which performs transmission with a receiver 1 through the transmission line 3.

In other words, the smoke sensor of the example of FIG. 17 is configured as a so-called sensor address type sensor (in view of the detection output signal, the sensor belongs to an ON/OFF type sensor). In the configuration of FIG. 17, when the physical quantity detecting unit 41 has the functions of the first light emitting means 12, the second light emitting means 13, and the light receiving means 14 of FIG. 1, 12, or 14 (for example, the functions of $LED_1$, $LED_2$, and PD of FIG. 2, 13, 15, or 16), the functions of the controlling means 11, the calculating means 15, and the smoke detection processing means 16 of FIG. 1, 12, or 14 can be realized by the CPU 44. The function of the outputting means 17 of FIG. 1, 12, or 14 can be realized by the state output unit 48 and the transmission unit 49.

In the RAM 46 and the nonvolatile memory 47 of FIG. 17, and other memories, for example, values such as the output values y(n) and g(n) which are alternately output from the physical quantity detecting unit 41 (the light receiving means 14), the estimated values y'(n) and g'(n) in the calculating means 15, the moving average, and the two-wavelength ratio can be stored.

For example, the thus configured smoke sensor may be used as an element of a monitor control system (e.g., a disaster prevention system) so as to be incorporated into the monitor control system (e.g., a disaster prevention system) as shown in FIG. 17. Referring to FIG. 17, the monitor control system (e.g., a disaster prevention system) has the receiver (e.g., an addressable p-type receiver) 1, and smoke sensors 2 which are monitored and controlled by the receiver 1 and which are configured as described above.

The smoke sensors 2 are connected to the predetermined transmission line (for example, L and C lines) 3 which elongates from the receiver 1. In the system of the example of FIG. 17, for example, the monitor level may be set to a potential of 24 V between L and C of the transmission line 3, the operation level (ON level) of the smoke sensor to a potential of 5 V between L and C, and the short-circuit level to a potential of 0 V between L and C.

In accordance with the system configuration, the state output unit 48 of the smoke sensor of FIG. 17 sets the potential between L and C of the transmission line 3 to the ON level or 5 V, as the signal indicative of the operation state (the ON state) of the sensor.

When at least one of the smoke sensors 2 operates (is turned ON) and the receiver 1 senses that the potential between L and C of the transmission line 3 is changed to 5 V, the receiver generates address search pulses by using the potentials of the sensors or the short-circuit level (0 V) and the ON level (5 V), and transmits the pulses to the sensors 2 through the transmission line 3.

The transmission unit 49 of the sensor of FIG. 17 is configured so as to receive such address search pulses from the receiver 1 through the transmission line 3, i.e., the lines L and C. When the transmission unit 49 receives the address search pulses, the CPU 44 of the sensor counts the number of address search pulses which has been received, judges whether the count value coincides with the address set in the address unit 43 of the sensor, and, if the count value coincides with the address, supplies the state (ON state or OFF state) of the own sensor to the transmission unit 49. In response to this, only when the own sensor is in the ON state, for example, the transmission unit 49 transmits the signal indicative of the state to the receiver 1 through the transmission line 3, i.e., the lines L and C. Specifically, when the address coincides with the own address, the transmission unit 49 transmits to the receiver 1 the signal indicating that the own sensor is in the ON state, by, for example, holding the potential between L and C of the transmission line 3 to 0 V for a predetermined time period (by holding the short-circuit state for a predetermined time period). Therefore, the receiver 1 monitors whether the potential between L and C of the transmission line 3 is held to 0 V for the predetermined time period. If the potential between L and C of the transmission line 3 is held to 0 V for the predetermined time period, the receiver can determine that the sensor of the address corresponding to the number of the address search pulses which have been output is in the operation state (ON state).

In the above-described example of FIG. 17, the smoke sensor is configured as a sensor address type sensor. The smoke sensor may have the configuration of FIG. 1, 12, or 14, or may be any ON/OFF type smoke sensor. In the configuration example of FIG. 17, therefore, the address unit 43 and the like are not necessary.

Figure 18:
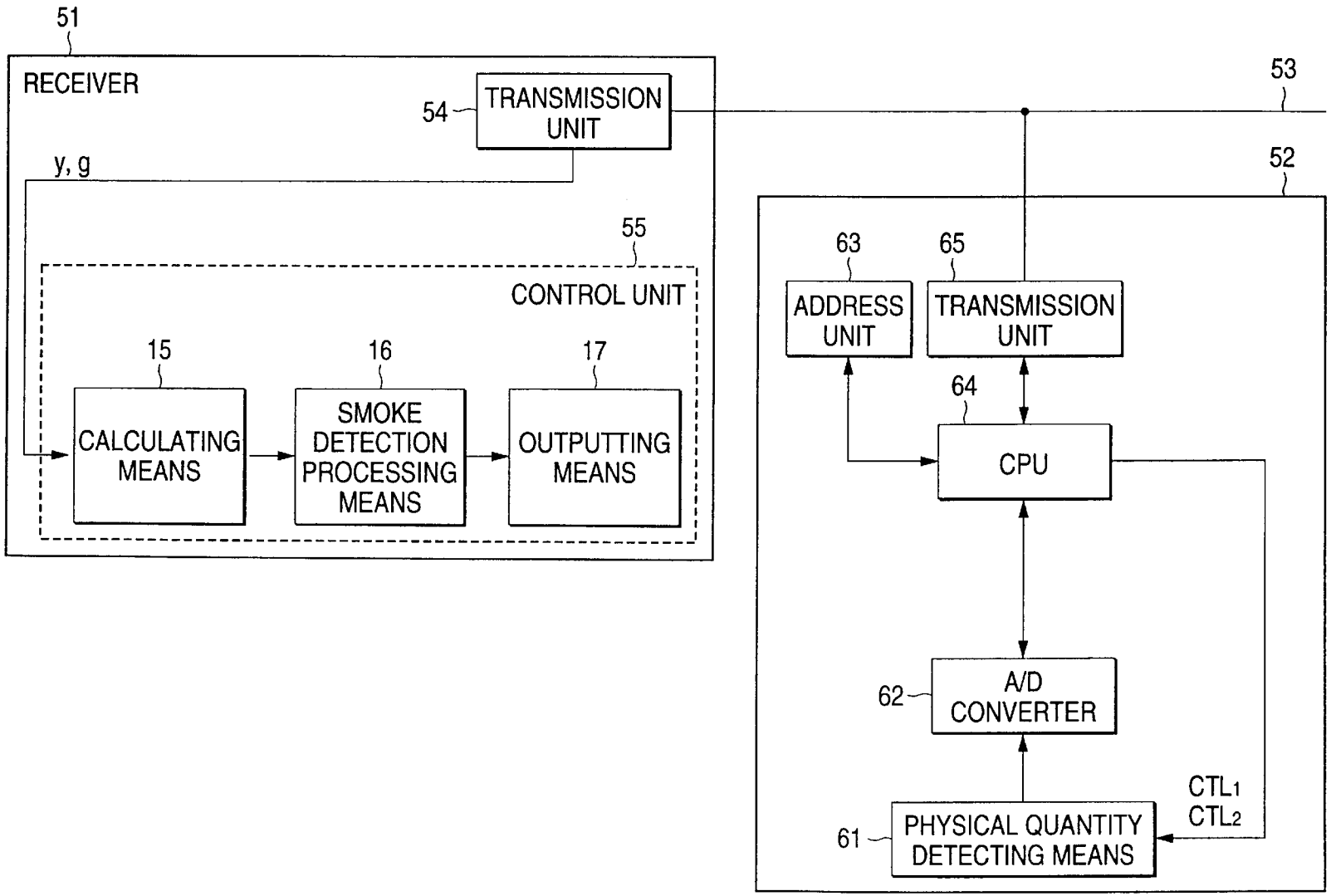
FIG. 18 is a diagram showing an example of the configuration of the monitor control system of the invention.

In the above, the example in which the invention is applied to an ON/OFF type smoke sensor has been described. The invention may be applied to a receiver of an R type monitor control system (a smoke sensor system, a disaster prevention system, or the like) in which, for example, an analog smoke sensor is used. FIG. 18 is a diagram showing an example of an R type monitor control system in which, for example, an analog smoke sensor is used. Referring to FIG. 18, the monitor control system has a receiver (e.g., an R-type receiver) 51, and an analog scattering smoke sensor 52 which is connected to a transmission path 53 elongating from the receiver 51 and which is monitored and controlled by the receiver 51.

As the light scattering smoke sensor 52, a smoke sensor configured so as to temporally alternately receive two different wavelengths $\lambda_1$ and $\lambda_2$ is used. Namely, the light scattering smoke sensor 52 comprises: physical quantity detecting means 61 for detecting the smoke density as a physical quantity and converting the physical quantity into an electric signal (analog signal); an A/D converter 62 which samples the analog signal output from the physical quantity detecting means 61 with a predetermined period to convert the signal into a digital signal; an address unit 63 into which the address of the smoke sensor is set; a CPU 64 which controls the whole of the sensor in synchronization with the period of address polling from the receiver 51; and a transmission unit 65 which performs transmission of data and signals with the receiver 51.

For example, the physical quantity detecting means 61 is provided with functions of: first light emitting means 12 for, when driven by a driving signal $CTL_1$ from the CPU 64, emitting light of a wavelength $\lambda_1$; second light emitting means 13 for, when driven by a driving signal $CTL_2$ from the CPU 64, emitting light of a wavelength $\lambda_2$; and light receiving means 14 for receiving scattered light of the light of a wavelength $\lambda_1$ emitted from the first light emitting means 12, and scattered light of the light of a wavelength $\lambda_2$ emitted from the second light emitting means 13. The CPU 64 is configured so that, in response of the address polling from the receiver 51, the driving signals $CTL_1$ and $CTL_2$ are output with a time difference t, scattered light output signals for the two different wavelengths $\lambda_1$ and $\lambda_2$ which are temporally alternately output from the physical quantity detecting means 61 are converted into digital signals by the A/D converter 62, and the scattered light output data of the two different wavelengths $\lambda_1$ and $\lambda_2$ are sent from the transmission unit 65 to the receiver 51.

In this case, the receiver 51 has a transmission unit 54 which performs a control of transmission with the light scattering smoke sensor 52, and a control unit 55 which performs a smoke detection process, etc. The control unit 55 of the receiver 51 is provided with functions of: calculating means 15 for performing a predetermined calculation required for smoke detection on a scattered light output y of the wavelength $\lambda_1$ and a scattered light output g of the wavelength $\lambda_2$ supplied from the light scattering smoke sensor 52; smoke detection processing means 16 for performing a smoke detection process on the basis of a calculation result output from the calculating means 15; and outputting means 17 for outputting a result of the smoke detection process. The calculating means 15 has the configuration of FIG. 4 or 5, and may further have the function of the moving average process.

In this configuration, when the receiver 51 performs address polling on the light scattering smoke sensor 52 and receives from the light scattering smoke sensor 52 the scattered light output y of the wavelength $\lambda_1$ and the scattered light output g of the wavelength $\lambda_2$, the calculating means 15 performs the predetermined calculation required for smoke detection, namely, the estimation process (for example, the interpolation process), the two-wavelength ratio calculation process, and the moving average process, on the scattered light output y of the wavelength $\lambda_1$ and the scattered light output g of the wavelength $\lambda_2$ from the light scattering smoke sensor 52. Therefore, the two-wavelength ratio can be correctly calculated. The smoke detection processing means 16 performs a smoke detection process on the basis of the two-wavelength ratio which is correctly calculated by the calculating means 15 (determines the kind (characteristic) of smoke, and judges whether a fire breaks out or not, based on the kind of smoke). The result of the smoke detection process can be output from the outputting means 17. When it is judged that a fire breaks out, for example, an alarm output or the like can be conducted.

As described above, the invention can be applied to a smoke sensor itself, and, when an analog smoke sensor is used, can be applied also to a receiver. In both the cases, a correct two-wavelength ratio can be obtained, and a smoke detection process and a fire judgment process can be performed with high reliability.

Figure 19:
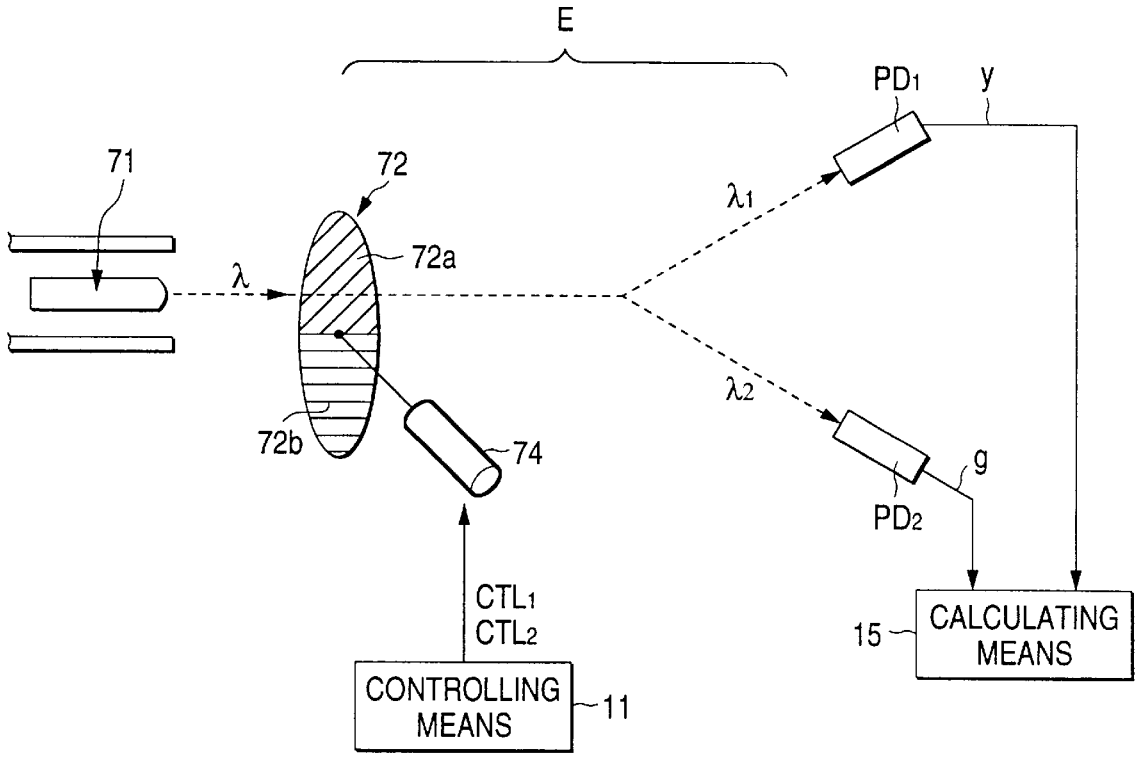
FIG. 19 is a diagram showing another example of the configuration of the physical quantity detecting unit.

In the examples described above, as shown in FIG. 2 and the like, the physical quantity detecting unit 41 or 61 of the light scattering smoke sensor (of the ON/OFF type or the analog type) uses the two kinds of light emitting means 12 and 13 ($LED_1$ and $LED_2$) for respectively emitting light of the wavelengths $\lambda_1$ and $\lambda_2$ (in other words, two light sources are used). Alternatively, as shown in FIG. 19, for example, only a single light source 71 (e.g., a tungsten lamp) may be used as the light source, and light of a predetermined wavelength $\lambda$ from the single light source 71 may be converted into light of wavelengths $\lambda_1$ and $\lambda_2$ by an interference filter 72 having different wavelength characteristics (by rotating the interference filter 72 one half turn by a motor 74 to alternately switch over the wavelength characteristics). In the alternative, for example, the first light emitting means 12 of FIG. 1 is realized by the single light source 71 and a portion 72*a* of the wavelength characteristic $\lambda_1$ in the interference filter 72, and the second light emitting means 13 is realized by the single light source 71 and a portion 72*b* of the wavelength characteristic $\lambda_2$ in the interference filter 72.

In the examples of FIG. 2 and so on, the single light receiving device PD is used in the light receiving means 14.

As shown in the example of FIG. 19, the light receiving means 14 of FIG. 1, 12, or 14 may be realized by two light receiving devices $PD_1$ and $PD_2$.

In the configuration of FIG. 19, the interference filter 72 may not be disposed, and light receiving devices having different spectral sensitivities may be used as the two light receiving devices $PD_1$ and $PD_2$.

In other words, the invention can be applied to any smoke sensor, and a receiver or a monitor and a control system using such a smoke sensor as far as they are configured so that light receiving means temporally alternately receives scattered light of two different wavelengths $\lambda_1$ and $\lambda_2$.

When a smoke sensor or a receiver is to be provided with the calculation processing function of the invention (the estimation process (functions such as the interpolation process), the two-wavelength ratio calculation process, and the moving average process), these functions can be provided in the form of a software package (specifically, an information recording medium such as a CD-ROM). In other words, programs for executing the functions such as the calculating means 15 of the invention (in the case of the smoke sensor of FIG. 12, for example, programs which are to be used in the CPU 44 and the like) can be provided in the form of recording on a portable information recording medium.

In this case, preferably, the smoke sensor or the receiver is provided with a mechanism for detachably loading an information recording medium. The information recording medium on which programs and the like are recorded is not restricted to a CD-ROM, and a ROM, a RAM, a flexible disk, a memory card, or the like may be used as the information recording medium. When the information recording medium is loaded into the smoke sensor or the receiver, programs recorded on the information recording medium are installed into a storage device of the smoke sensor or the receiver (in the smoke sensor of FIG. 17, for example, the RAM 46), so that the programs are executed to realize the calculation processing function of the invention.

Programs for realizing the calculation processing function of the invention may be provided to the smoke sensor or the receiver, not only in the form of a medium but also by a communication (for example, by a server).

As described above, according to the invention of the first to tenth aspects, in a scattered light in which light receiving means temporally alternately receives scattered light of two different wavelengths $\lambda_1$ and $\lambda_2$, the smoke sensor comprises: calculating means for performing a predetermined calculation required for smoke detection, on a scattered light output y of the wavelength $\lambda_1$ and a scattered light output g of the wavelength $\lambda_2$ from the light receiving means; and smoke detection processing means for performing a smoke detection process on the basis of a calculation result output from the calculating means, and the calculating means estimates an output value of one of the scattered light output y of the wavelength $\lambda_1$ and the scattered light output g of the wavelength $\lambda_2$ which are temporally alternately output from the light receiving means, at a sample timing of the other output, and obtains a ratio of the estimated output value of the one scattered light at the sample timing of the other output to an output value of the other scattered light, as a two-wavelength ratio. Therefore, the two-wavelength ratio can be correctly obtained and the accuracy of smoke detection can be remarkably enhanced as compared with the prior art.

According to the invention of the third to fifth aspects, in the calculation of the two-wavelength ratio, also a moving average is performed. Therefore, a temporal smoothing process is performed, and hence an effect due to temporal fluctuation of smoke density or the like can be remarkably reduced, and the two-wavelength ratio can be obtained more correctly.

According to the invention of the sixth aspect, in the smoke sensor according to any one of the first to fifth aspects, when or after the output value of one of the scattered light output y of the wavelength $\lambda_1$ and the scattered light output g of the wavelength $\lambda_2$ from the light receiving means is equal to or larger than a predetermined value, the calculating means starts the calculation required for smoke detection. Therefore, it is not required to always perform a calculation. Consequently, the load of the calculating means (specifically, a CPU) can be reduced and an influence of noises can be reduced so that the smoke detection error can be further reduced.

According to the invention of the eleventh aspect, the smoke sensor comprises: controlling means for controlling a whole of the sensor; first light emitting means for, when driven by the controlling means, emitting light of a wavelength $\lambda_1$; second light emitting means for, when driven by the controlling means, emitting light of a wavelength $\lambda_2$; light receiving means for receiving scattered light of the light of the wavelength $\lambda_1$ emitted from the first light emitting means, and scattered light of the light of the wavelength $\lambda_2$ emitted from the second light emitting means; calculating means for performing a predetermined calculation required for smoke detection on a scattered light output y of the wavelength $\lambda_1$ and a scattered light output g of the wavelength $\lambda_2$ from the light receiving means; and smoke detection processing means for performing a smoke detection process on the basis of a calculation result output from the calculating means, the first and second light emitting means being incorporated in a single light emitting device, the light of the wavelength $\lambda_1$ and the light of the wavelength $\lambda_2$ being emitted from the single light emitting device. Therefore, the first light emitting means 12 and the second light emitting means 13 can be located at positions which are very close to each other, and the light of the wavelength $\lambda_1$ emitted from the first light emitting means 12, and the light of the wavelength $\lambda_2$ emitted from the second light emitting means 13 are directed in the same light emission direction. In a light scattering smoke sensor, therefore, smoke detection spaces can be made identical with each other, so that the two-wavelength ratio can be correctly obtained. In appearance, the configuration example of FIGS. 12 and 13 is configured by the single light emitting device 18 and the single light receiving device (light receiving means) 14. Therefore, the configuration has an advantage that the structure of a light scattering smoke sensor of the prior art can be used as it is and a product of a low cost can be supplied.

According to the invention of twelfth to fourteenth aspects, the smoke sensor comprises: controlling means for controlling a whole of the sensor; first light emitting means for, when driven by the controlling means, emitting light of a wavelength $\lambda_1$; second light emitting means for, when driven by the controlling means, emitting light of a wavelength $\lambda_2$; light receiving means for receiving scattered light of the light of the wavelength $\lambda_1$ emitted from the first light emitting means, and scattered light of the light of the wavelength $\lambda_2$ emitted from the second light emitting means; calculating means for performing a predetermined calculation required for smoke detection on a scattered light output y of the wavelength $\lambda_1$ and a scattered light output g of the wavelength $\lambda_2$ from the light receiving means; and smoke detection processing means for performing a smoke detection process on the basis of a calculation result output from the calculating means, the smoke sensor further comprising light guiding means for guiding the light of the wavelength $\lambda_1$ emitted from the first light emitting means, and the light of the wavelength $\lambda_2$ emitted from the second light emitting means so that the light of the wavelength $\lambda_2$ emitted from the first light emitting means, and the light of the wavelength $\lambda_2$ emitted from the second light emitting means are directed in a same light emission direction. Therefore, the light emission direction and emission light path of the light of the wavelength $\lambda_1$ emitted from the first light emitting means 12 can be made identical with those of the light of the wavelength $\lambda_2$ emitted from the second light emitting means 13. In a light scattering smoke sensor, therefore, smoke detection spaces can be made identical with each other, so that the two-wavelength ratio can be correctly obtained. The use of a prism or an optical fiber enables the first and second light emitting means 12 and 13 (i.e., the two $LED_1$ and $LED_2$ of two different wavelengths) to be independently selected, and hence best devices such as those of high luminance can be used.

According to the invention of the fifteenth aspect, in the monitor control system comprising a receiver, and an analog light scattering smoke sensor which is connected to a transmission path elongating from the receiver and which is monitored and controlled by the receiver, when the analog light scattering smoke sensor is a smoke sensor which temporally alternately receives scattered light of two different wavelengths $\lambda_1$ and $\lambda_2$, the receiver comprises: calculating means for performing a predetermined calculation required for smoke detection, on a scattered light output y of the wavelength $\lambda_1$ and a scattered light output g of the wavelength $\lambda_2$ from the light receiving means; and smoke detection processing means for performing a smoke detection process on the basis of a calculation result output from the calculating means, and the calculating means estimates an output value of one of the scattered light output y of the wavelength $\lambda_1$ and the scattered light output g of the wavelength $\lambda_2$ which are temporally alternately output from the light scattering smoke sensor, at a sample timing of the other output, and obtains a ratio of the estimated output value of the one scattered light at the sample timing of the other output to an output value of the other scattered light, as a two-wavelength ratio. Therefore, the receiver can correctly obtain the two-wavelength ratio and the accuracy of smoke detection can be remarkably enhanced as compared with the prior art.

What is claimed is:

1. A smoke sensor comprising:

light receiving means for temporally alternately receiving scattered light of two different wavelengths $\lambda_1$ and $\lambda_2$;

calculating means for performing a calculation required for smoke detection, on a scattered light output y of the wavelength $\lambda_1$ and a scattered light output g of the wavelength $\lambda_2$ from said light receiving means; and smoke detection processing means for performing a smoke detection process on the basis of a calculation result output from said calculating means, said calculating means estimating an output value of one of the scattered light output y of the wavelength $\lambda_1$ and the scattered light output g of the wavelength $\lambda_2$ which are temporally alternately output from said light-receiving means, at a sample timing of the other output, and obtaining a ratio of the estimated output value of the one scattered light at the sample timing of the other output to an output value of the other scattered light, as a two-wavelength ratio.

2. A smoke sensor according to claim 1, wherein said calculating means performs the estimation of the output value of one of the scattered light output y of the wavelength $\lambda_1$ and the scattered light output g of the wavelength $\lambda_2$ which are temporally alternately output from said light receiving means, by performing an interpolation on one of the scattered light output y of the wavelength $\lambda_1$ and the scattered light output g of the wavelength $\lambda_2$.

3. A smoke sensor according to claim 1, wherein said calculating means takes a moving average of each of the scattered light output y of the wavelength $\lambda_1$ and the scattered light output g of the wavelength $\lambda_2$ from said light receiving means, estimates an output value of one of the moving-averaged scattered light output y of the wavelength $\lambda_1$ and the moving-averaged scattered light output g of the wavelength $\lambda_2$, at a sample timing of the other output, and thereafter obtains a ratio of the estimated output value of the one moving-averaged scattered light at the sample timing of the other output to an output value of the other moving-averaged scattered light, as the two-wavelength ratio.

4. A smoke sensor according to claim 1, wherein, after estimating the output value of one of the scattered light output y of the wavelength $\lambda_1$ and the scattered light output g of the wavelength $\lambda_2$ which are temporally alternately output from said light receiving means, at a sample timing of the other output, said calculating means takes a moving average of the estimated output value and a moving average of the output value of the other scattered light, and obtains a ratio of the estimated output value of the one moving-averaged scattered light at the sample timing of the other output to an output value of the other moving-averaged scattered light, as the two-wavelength ratio.

5. A smoke sensor according to claim 1, wherein, after obtaining a ratio of the estimated output value of the one scattered light at the sample timing of the other output to the output value of the other scattered light, as the two-wavelength ratio, said calculating means takes a moving average on the two-wavelength ratio to obtain another two-wavelength ratio.

6. A smoke sensor according to claim 1, wherein, when or after the output value of one of the scattered light output y of the wavelength $\lambda_1$ and the scattered light output g of the wavelength $\lambda_2$ from said light receiving means is equal to or larger than a predetermined value, said calculating means starts the calculation required for smoke detection.

7. A smoke sensor according to claim 6, wherein, when, after the calculation required for smoke detection is started, the output value of one of the scattered light output y of the wavelength $\lambda_1$ and the scattered light output g of the wavelength $\lambda_2$ from said light receiving means reaches an upper limit value, said calculating means holds a calculation result which is obtained immediately before the output value reaches the upper limit value.

8. A smoke sensor according to claim 1, wherein said smoke detection processing means judges a smoke characteristic on the basis of the two-wavelength ratio from said calculating means.

9. A smoke sensor according to claim 8, wherein, when the smoke characteristic is judged, said smoke detection processing means variably sets a fire criterion for each smoke characteristic.

10. A smoke sensor according to claim 9, wherein said smoke detection processing means variably sets a fire level for judging whether a fire breaks out or not on the basis of the largeness of two wavelength ratio.

11. A smoke sensor comprising:

controlling means for controlling a whole of said sensor;

first light emitting means for, when driven by said controlling means, emitting light of a wavelength $\lambda_1$;

second light emitting means for, when driven by said controlling means, emitting light of a wavelength $\lambda_2$;

light receiving means for receiving scattered light of the light of the wavelength $\lambda_1$ emitted from said first light emitting means, and scattered light of the light of the wavelength $\lambda_2$ emitted from said second light emitting means;

calculating means for performing a calculation required for smoke detection on a scattered light output y of the wavelength $\lambda_1$ and a scattered light output g of the wavelength $\lambda_2$ from said light receiving means; and smoke detection processing means for performing a smoke detection process on the basis of a calculation result output from said calculating means, said first and second light emitting means being incorporated in a single light emitting device, and the light of the wavelength $\lambda_1$ and the light of the wavelength $\lambda_2$ being emitted from said single light emitting device.

12. A smoke sensor comprising:

controlling means for controlling a whole of said sensor;

first light emitting means for, when driven by said controlling means, emitting light of a wavelength $\lambda_1$;

second light emitting means for, when driven by said controlling means, emitting light of a wavelength $\lambda_2$;

light receiving means for receiving scattered light of the light of the wavelength $\lambda_1$ emitted from said first light emitting means, and scattered light of the light of the wavelength $\lambda_2$ emitted from said second light emitting means;

calculating means for performing a calculation required for smoke detection on a scattered light output y of the wavelength $\lambda_1$ and a scattered light output g of the wavelength $\lambda_2$ from said light receiving means;

smoke detection processing means for performing a smoke detection process on the basis of a calculation result output from said calculating means; and light guiding means for guiding the light of the wavelength $\lambda_1$ emitted from said first light emitting means, and the light of the wavelength $\lambda_2$ emitted from said second light emitting means so that the light of the wavelength $\lambda_1$ emitted from said first light emitting means, and the light of the wavelength $\lambda_2$ emitted from said second light emitting means are directed in a same light emission direction.

13. A smoke sensor according to claim 12, wherein said light guiding means is a prism.

14. A smoke sensor according to claim 12, wherein said light guiding means is a branched optical fiber.

15. A monitor control system comprising:

a receiver; and an analog light scattering smoke sensor which is connected to a transmission path elongating from said receiver and which is monitored and controlled by said receiver, wherein, when said analog light scattering smoke sensor is a smoke sensor which temporally alternately receives scattered light of two different wavelengths $\lambda_1$ and $\lambda_2$, said receiver comprises:

calculating means for performing a calculation required for smoke detection, on a scattered light output y of the wavelength $\lambda_1$ and a scattered light output g of the wavelength $\lambda_2$ from said light receiving means; and smoke detection processing means for performing a smoke detection process on the basis of a calculation result output from said calculating means, said calculating means estimating an output value of one of the scattered light output y of the wavelength $\lambda_1$ and the scattered light output g of the wavelength $\lambda_2$ which are temporally alternately output from said light scattering smoke sensor, at a sample timing of the other output, and obtaining a ratio of the estimated output value of the one scattered light at the sample timing of the other output to an output value of the other scattered light, as a two-wavelength ratio.

* * * * *